US008526034B2

(12) United States Patent
Okada

(10) Patent No.: US 8,526,034 B2
(45) Date of Patent: Sep. 3, 2013

(54) DATA OUTPUT DEVICE AND DATA OUTPUT METHOD

(75) Inventor: Kazuo Okada, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 1168 days.

(21) Appl. No.: 11/889,509

(22) Filed: Aug. 14, 2007

(65) Prior Publication Data

US 2008/0144089 A1 Jun. 19, 2008

Related U.S. Application Data

(60) Provisional application No. 60/874,681, filed on Dec. 14, 2006.

(51) Int. Cl.

| | |
|---|---|
| ***G06F 3/12*** | (2006.01) |
| *A63F 9/24* | (2006.01) |
| *A63F 13/00* | (2006.01) |
| *G06Q 30/00* | (2012.01) |
| *G06Q 10/00* | (2012.01) |

(52) U.S. Cl.

USPC ..... 358/1.15; 463/16; 463/20; 463/21; 463/25; 463/29; 705/7.33; 705/7.37; 705/14.12; 705/14.14; 705/14.27

(58) Field of Classification Search

USPC ..... 358/1.15; 463/16, 20, 21, 25, 29, 463/30, 42, 31, 37, 38, 39, 40, 43; 705/7.33, 705/14.12, 14.14, 14.27, 7.37

See application file for complete search history.

(56) References Cited

U.S. PATENT DOCUMENTS

| | | | | |
|---|---|---|---|---|
| 4,283,709 | A | 8/1981 | Lucero et al. | |
| 5,820,459 | A | 10/1998 | Acres et al. | |
| 6,003,013 | A | 12/1999 | Boushy et al. | |
| 6,234,896 | B1 * | 5/2001 | Walker et al. | 463/16 |
| 6,846,238 | B2 * | 1/2005 | Wells | 463/39 |
| 7,850,528 | B2 * | 12/2010 | Wells | 463/42 |
| 2003/0069073 | A1 | 4/2003 | Okada | |
| 2005/0215325 | A1 * | 9/2005 | Nguyen et al. | 463/46 |

FOREIGN PATENT DOCUMENTS

| | | |
|---|---|---|
| EP | 0631798 A1 | 1/1995 |
| JP | 2006204353 | 8/2006 |

OTHER PUBLICATIONS

Macao International Search Report, dated Feb. 2, 2009, English Translation Included.

* cited by examiner

*Primary Examiner* — Vu B Hang
*Assistant Examiner* — Neil R McLean
(74) *Attorney, Agent, or Firm* — Lexyoume IP Meister, PLLC.

(57) ABSTRACT

A data output device according to the present invention comprises: an output device capable of outputting an image and/or a sound; a memory which stores a plurality of types of output data for outputting the image and/or the sound; a receiver for receiving, from a slot machine, a trigger signal including specification information for specifying the output data; and a controller, the controller programmed to conduct the processes of: (A) receiving the trigger signal from the slot machine through the receiver; and (B) extracting, from the memory, an output data corresponding to the specification information included in the trigger signal and causing the output device to output the image and/or the sound based on the extracted output data.

19 Claims, 16 Drawing Sheets

Fig. 3

| | Left reel | Center reel | Right reel |
|---|---|---|---|
| Code No. | Symbol | Symbol | Symbol |
| 00 | JACKPOT 7 | JACKPOT 7 | JACKPOT 7 |
| 01 | PLUM | BELL | CHERRY |
| 02 | ORANGE | APPLE | ORANGE |
| 03 | PLUM | BELL | APPLE |
| 04 | ORANGE | CHERRY | ORANGE |
| 05 | PLUM | ORANGE | PLUM |
| 06 | ORANGE | PLUM | ORANGE |
| 07 | PLUM | CHERRY | PLUM |
| 08 | BLUE 7 | BELL | ORANGE |
| 09 | CHERRY | APPLE | PLUM |
| 10 | ORANGE | BELL | ORANGE |
| 11 | BELL | STRAWBERRY | PLUM |
| 12 | ORANGE | PLUM | BELL |
| 13 | STRAWBERRY | BLUE 7 | STRAWBERRY |
| 14 | BLUE 7 | BELL | BLUE 7 |
| 15 | ORANGE | APPLE | BELL |
| 16 | APPLE | BELL | CHERRY |
| 17 | PLUM | STRAWBERRY | PLUM |
| 18 | ORANGE | PLUM | ORANGE |
| 19 | PLUM | CHERRY | PLUM |
| 20 | BLUE 7 | BELL | ORANGE |
| 21 | CHERRY | APPLE | PLUM |

Fig. 8

Bonus games are being generated due to the elapse of 100 games !

Fig. 14

10 games to go until the occurrence of bonus games !

DATA OUTPUT DEVICE AND DATA OUTPUT METHOD

CROSS-REFERENCE TO RELATED APPLICATIONS

This application claims benefit of priority based on U.S. Provisional Patent Application No. 60/874,681 filed on Dec. 14, 2006. The contents of this application are incorporated herein by reference in their entirety.

BACKGROUND OF THE INVENTION

1. Field of the Invention

The present invention relates to a data output device and a data output method.

2. Discussion of the Background

US 2003/0069073-A1 discloses a system configured to offer a predetermined return to players who have consumed a predetermined value of gaming mediums. This system includes plural slot machines and a server, wherein the server cumulatively sums a portion of the consumed value of each slot machine and, if the consumed value of one slot machine has reached a predetermined upper limit value, offers a return to the slot machine based on the value accumulated by the server.

The return is offered to a player who has consumed a predetermined value of gaming mediums and, therefore, is different from conventional jackpots which are offered to players at random (refer to U.S. Pat. No. 4,283,709, U.S. Pat. No. 5,820,459, and U.S. Pat. No. 6,003,013). Accordingly, information about the fact that a return is being offered, information about the value of gaming mediums required to be consumed for causing a return and the like are of great value for players. Thus, there is a need for a novel method for offering such information.

The contents of US 2003/0069073-A1, U.S. Pat. No. 4,283,709, U.S. Pat. No. 5,820,459, and U.S. Pat. No. 6,003,013 are incorporated herein by reference in their entirety.

SUMMARY OF THE INVENTION

According to the first aspect of the present invention, there is provided a data output device having the following configuration.

That is, a data output device according to the first aspect of the present invention comprises: an output device capable of outputting an image and/or a sound; a memory which stores a plurality of types of output data for outputting the image and/or the sound; a receiver for receiving, from a slot machine, a trigger signal including specification information for specifying the output data; and a controller. Here, the controller is programmed to conduct the processes of: (A) receiving the trigger signal from the slot machine through the receiver; and (B) extracting, from the memory, an output data corresponding to the specification information included in the trigger signal and causing the output device to output the image and/or the sound based on the extracted output data.

According to the second aspect of the present invention, there is provided a data output device having the following configuration.

That is, a data output device according to the second aspect of the present invention comprises: an output device capable of outputting an image and/or a sound; a memory which stores a plurality of types of output data for outputting the image and/or the sound and identification information for identifying a slot machine installed in association with the data output device; a receiver for receiving, from a server connected to the slot machine, a trigger signal including specification information for specifying output data and the identification information of the slot machine; and a controller. Here, the controller is programmed to conduct the processes of: (A) receiving the trigger signal from the slot machine through the receiver; (B) determining whether or not the identification information included in the trigger signal matches the identification information stored in the memory; and (C) extracting, from the memory, an output data corresponding to the specification information included in the trigger signal and causing the output device to output the image and/or the sound based on the extracted output data, upon determining through the process (B) that the identification information included in the trigger signal matches the identification information stored in the memory.

According to the third aspect of the present invention, there is provided a data output device having the following configuration.

That is, a data output device according to the third aspect of the present invention comprises: a transmitter for transmitting a request signal for making a request for transmission of game data to a slot machine or a server; a receiver for receiving the game data transmitted from the slot machine or the server which received the request signal; an output device capable of outputting an image and/or a sound; a memory which stores a plurality of types of output data for outputting the image and/or the sound; and a controller. Here, the controller is programmed to conduct the processes of: (A) transmitting the request signal to the slot machine or the server through the transmitter; (B) receiving the game data from the slot machine or the server through the receiver; and (C) extracting, from the memory, an output data for outputting information based on the game data and causing the output device to output the image and/or the sound based on the extracted output data.

The first aspect of the present invention further provides a data output method comprising the following steps:

(a) receiving a trigger signal including specification information for specifying output data, the trigger signal output from a slot machine and received through a receiver; and (b) extracting an output data corresponding to the specification information included in the trigger signal, from a memory which stores a plurality of types of output data, and causing an output device capable of outputting an image and/or a sound to output the image and/or the sound based on the extracted output data.

Here, each of the steps (a) and (b) is conducted by a controller.

The second aspect of the present invention further provides a data output method comprising the following steps:

(a) receiving a trigger signal including specification information for specifying output data and identification information for identifying a slot machine, the trigger signal received through a receiver which receives the trigger signal from a server connected to the slot machine;

(b) determining whether or not the identification information included in the trigger signal matches identification information of the slot machine, the identification information of the slot machine being pre-stored in a memory, the slot machine being installed in association with a controller; and (c) extracting an output data corresponding to the specification information included in the trigger signal out of a plurality of types of output data for outputting an image and/or a sound, the plurality of types of output data being pre-stored in the memory, and causing an output device capable of outputting the image and/or the sound to output the image and/or the sound based on the extracted output data, upon determining through the step (b) that the identification information included in the trigger signal matches the identification information of the slot machine.

Here, each of the steps (a) to (c) is conducted by the controller.

The third aspect of the present invention further provides a data output method comprising the following steps:

(a) transmitting a request signal for making a request for transmission of game data, the request signal transmitted to a slot machine or a server through a transmitter;

(b) receiving the game data from the slot machine or the server through a receiver; and (c) extracting an output data for outputting information based on the game data, from a memory which stores a plurality of types of output data for outputting an image and/or a sound, and causing an output device capable of outputting the image and/or the sound to output the image and/or the sound based on the extracted output data.

Here, each of the steps (a) to (c) is conducted by a controller.

In the third aspect of the present invention, the following configuration can be employed.

The aforementioned game data can be game history data of players, wherein the game history data can include data of the numbers of games and/or data of the cumulative numbers of BETs. The information based on the aforementioned game data is the number of remaining BETs or the number of remaining games until the cumulative number of BETs reaches a predetermined upper limit value.

In the data output device according to the third aspect of the present invention, it is possible to employ a configuration in which the aforementioned controller conducts the process (A) at predetermined time intervals.

In the data output method according to the third aspect of the present invention, it is possible to employ a configuration in which the process (c) is conducted at predetermined time intervals.

BRIEF DESCRIPTION OF THE DRAWINGS

FIG. 3 is a schematic view illustrating the symbol rows drawn on the peripheral surfaces of respective reels.

FIG. 8 is a view illustrating an exemplary image which is displayed to a image display panel.

FIG. 14 is a view illustrating an exemplary image which is displayed to the image display panel.

DESCRIPTION OF THE EMBODIMENTS

Hereinafter, there will be described a ceiling notification device (data output device) according to an embodiment of the present invention.

Figure 1:
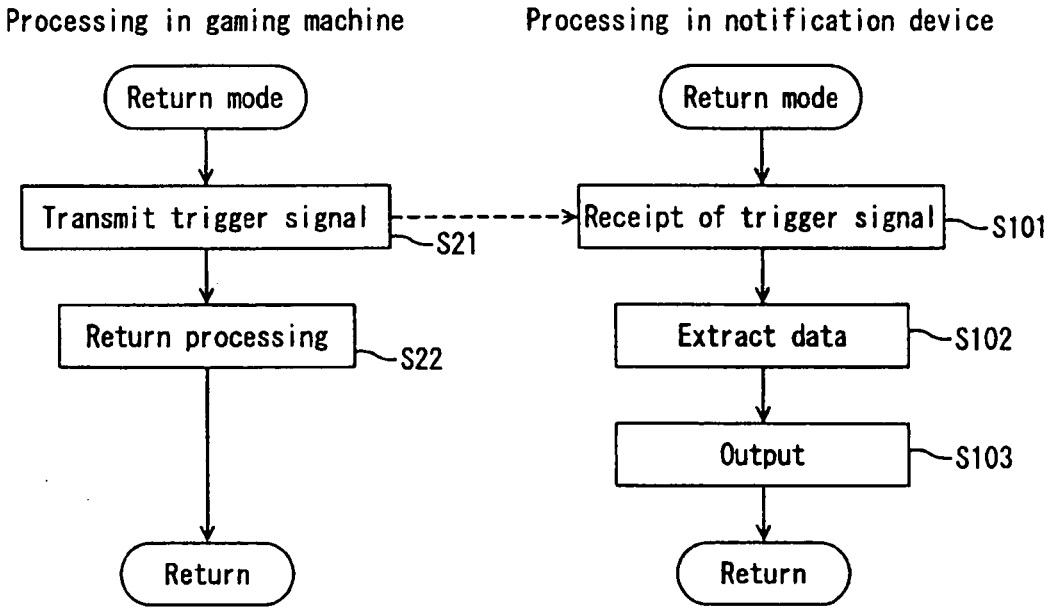
FIG. 1 is a flow chart illustrating processing in a gaming machine and in a ceiling notification device, according to a first embodiment of the present invention.

FIG. 1 is a flow chart illustrating processing in a gaming machine and in a ceiling notification device (data output device), according to a first embodiment of the present invention.

The ceiling notification device is separated from the gaming machine and is connected to the gaming machine through a communication line such as a cable. If a game being executed in the gaming machine is shifted to a return mode which will be described later, the gaming machine transmits a trigger signal to the ceiling notification device (step S21). On receiving the trigger signal from the gaming machine (step S101), the ceiling notification device extracts, from a memory (not illustrated) incorporated in this device, output data corresponding to specification information included in the trigger signal (step S102) and outputs an image or a sound based on the extracted output data (step S103). On the other hand, the gaming machine conducts return processing (step S22) after outputting the trigger signal to the ceiling notification device, which causes the game being executed in the gaming machine to shift to the return mode.

Hereinafter, with reference to FIGS. 1 to 8, there will be described a ceiling notification device according to an embodiment of the present invention.

Figure 2:
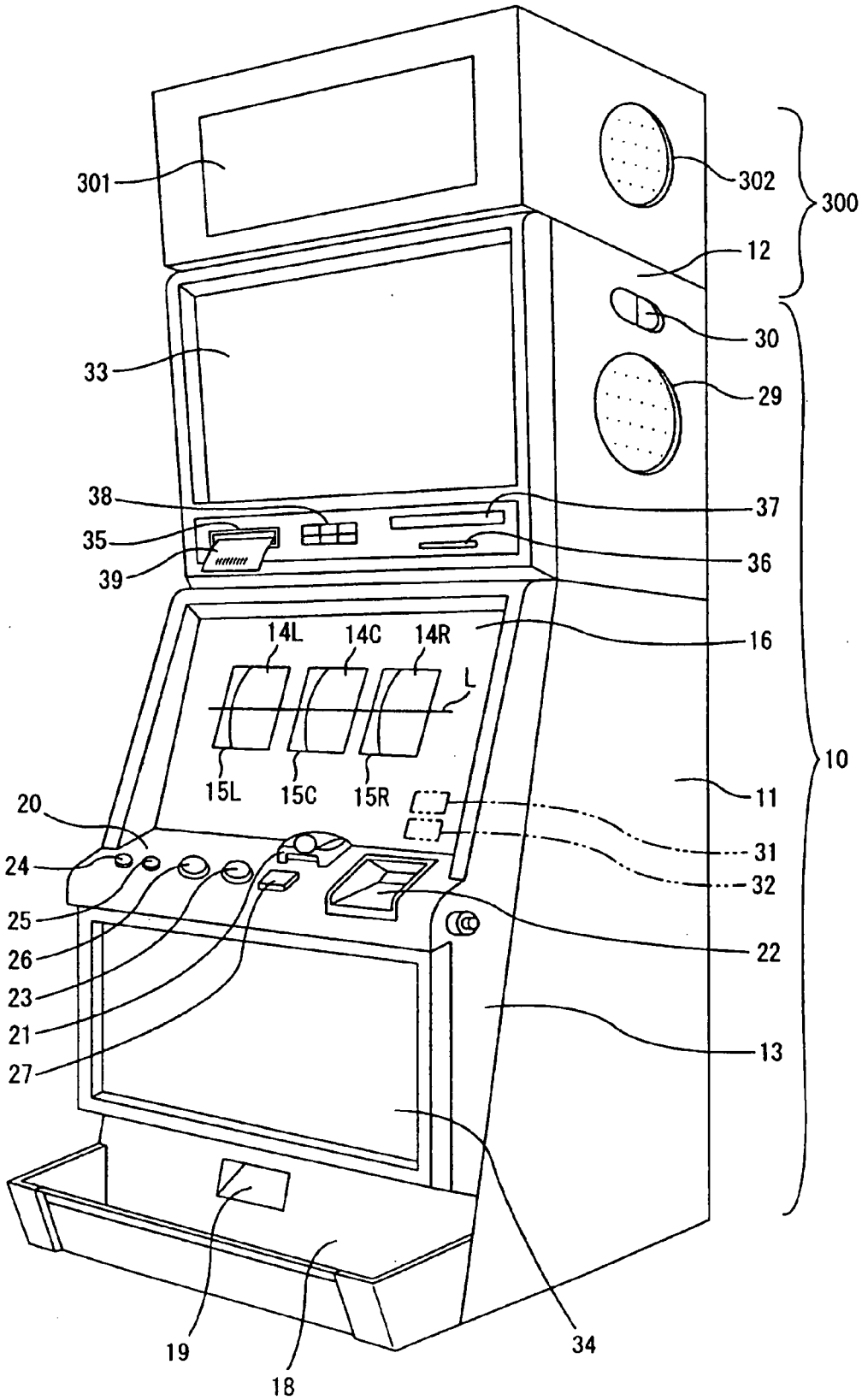
FIG. 2 is a perspective view schematically illustrating a gaming machine and a ceiling notification device according to an embodiment of the present invention.

FIG. 2 is a perspective view schematically illustrating a gaming machine and a ceiling notification device according to an embodiment of the present invention.

As illustrated in FIG. 2, the ceiling notification device 300 is installed at the upper portion of the gaming machine 10. The ceiling notification device 300 is externally mounted to the gaming machine 10 such that it is detachable. The ceiling notification device 300 corresponds to a data output device according to the present invention.

An image display panel 301 is provided in the front surface of the ceiling notification device 300, while a speaker 302 is provided in a side surface of the ceiling notification device 300. The image display panel 301 includes a transparent liquid crystal display panel which displays images indicative of information about the fact that a return is being conducted, information about the value of to-be-consumed coins required for causing a return, and the like. Further, such a return will be described later. The image display panel 301 is an image output device and functions as an output means capable of outputting images. Further, the speaker 302 outputs sounds including information about the fact that a return is being conducted, information about the value of to-be-consumed coins required for causing a return, and the like. The speaker 302 is a sound output device and functions as an output means capable of outputting sounds. The image display panel 301 and the speaker 302 correspond to an output device according to the present invention.

In the present embodiment, the image display panel 301 and the speaker 302 are provided as output devices; however, the present invention is not limited to the case. For example, only the image display panel 301 or only the speaker 302 can be provided. Further, it is also possible to design and change, as required, the position and aspect at and with which the image display panel 301 and the speaker 302 are installed. Further, the output device according to the present invention is not limited to devices which output the image or the sound. For example, it is possible to offer light effects using lamps and the like.

Although it can be said that the present invention relates to the ceiling notification device 300, the gaming machine 10 will be described at first, hereinafter, since a player plays games with the gaming machine 10.

In the present embodiment, the gaming machine 10 is a slot machine. The gaming machine 10 employs, as gaming mediums, coins, bills or electronic valuable information corresponding thereto. However, in the present invention, there is no particular limitation on gaming mediums, but examples thereof may include: medals, tokens, electronic money and tickets. Further, there is no particular limitation on the aforementioned tickets, but such tickets can be, for example, a ticket with a barcode, as will be described later. Hereinafter, gaming mediums will be collectively referred to as "coins".

The gaming machine 10 includes a cabinet 11, a top box 12 installed at the upper side of the cabinet 11, and a gaming-machine controlling door 13 provided in the front surface of the cabinet 11. Within the cabinet 11, there are rotatably provided three reels 14 (14L, 14C and 14R). On the outer peripheral surfaces of the respective reels 14, there are drawn rows of symbols, wherein each row of symbols is constituted by 22 figures (hereinafter, referred to as "symbols").

A lower image display panel 16 is provided at a portion of the gaming-machine controlling door 13 such that it comes in front of the reels 14. The lower image display panel 16 includes a transparent liquid crystal display panel which displays, during games, various types of information and effective images and the like relating to games. The lower image display panel 16 is an image output device and functions as an output means capable of outputting images.

In the lower image display panel 16, there are provided a number-of-credits display section 31 and a number-of-payouts display section 32. The number-of-credits display section 31 displays an image indicative of the number of credited coins. The number-of-payouts display section 32 displays an image indicative of the number of coins which are to be paid out, if a predetermined combination of symbols are statically displayed along a winning line L.

In the lower image display panel 16, there are formed three display windows 15 (15L, 15C and 15R) which enable viewing the portions therebehind, so that three symbols drawn on the outer peripheral surfaces of each of the reels 14 are displayed through the respective display windows 15. In the lower image display panel 16, there is formed a single winning line L horizontally across the three display windows 15. The winning line L defines the symbols arranged thereon as the combination of symbols. If a predetermined combination of symbols is statically displayed along the winning line L, then a number of coins corresponding to the combination and the number of inserted coins (the number of BETs) are paid out.

Also, in the present invention, there may be formed plural winning lines L horizontally or obliquely across the three display windows 15 and a number of winning lines L corresponding to the number of inserted coins can be made effective so that, if a predetermined combination of symbols is statically displayed along the winning lines L made to be effective, then a number of coins corresponding to the combination can be paid out.

Further, although not illustrated, a touch panel 69 is provided in the front surface of the lower image display panel 16, which enables a player to input various types of commands by operating the touch panel 69.

Under the lower image display panel 16, there are provided a control panel 20 constituted by plural buttons 23 to 27 which enable the player to input commands relating to proceeding of games, a coin receiving port 21 which receives coins and introduces them into the cabinet 11, and a bill validator 22.

On the control panel 20, there are provided a spin button 23, a change button 24, a cash-out button 25, a 1-BET button 26 and a maximum-BET button 27. The spin button 23 is for inputting a command for starting the rotation of the reels 14. The change button 24 is used for making a request of personnel of the game facility to exchange credits. The cash-out button 25 is for inputting a command for paying out credited coins to a coin tray 18.

The 1-BET button 26 is for inputting a command for betting a single coin, out of credited coins, on games. The maximum-BET button 27 is for inputting a command for betting, on games, a maximum number of coins which can be betted on a single game (50 coins in the present embodiment), out of the credited coins.

The bill validator 22 identifies whether or not bills are valid and also receives valid bills and introduces them to the inside of the cabinet 11. Further, the bill validator 22 can be configured to be capable of reading a ticket 39 with a barcode which will be described later. In the lower front surface of the gaming-machine controlling door 13, i.e., under the control panel 20, there is provided a belly glass 34 having a character or the like of the gaming machine 10 depicted thereon.

In the front surface of the top box 12, there is provided an upper image display panel 33. The upper image display panel 33 includes a liquid crystal display panel which displays images indicative of introduction of the contents of games and explanation of the rules of games, for example. While, in the gaming machine 10 according to the present embodiment, the lower image display panel 16 is an image output device which functions as an output means, in the present invention, the lower image display panel 33 can be an image output device which functions as an output means.

Further, a speaker 29 is provided in the top box 12. The speaker 29 is a sound output device and functions as an output means capable of outputting sounds. Under the upper image display panel 33, there are provided a ticket printer 35, a card reader 36, a data display device 37, and a keypad 38. The ticket printer 35 prints, onto a ticket, a barcode created by encoding data of the number of credits, time and date, the identification number of the gaming machine 10 and the like and outputs the ticket as a ticket 39 with a barcode. The player can cause another gaming machine to read the ticket 39 with a barcode for playing games with this gaming machine or can convert the ticket 39 with a bar-code into bills and the like at a predetermined site (for example, a cashier in a casino) in the game facility.

The card reader 36 reads and writes data from and into a smart card. The smart card is a card which is possessed by a player and stores, for example, data for identifying the player, data relating to the history of games played by the player. The smart card can store data corresponding to coins, bills or credits. Also, instead of such a smart card, it is possible to employ a magnetic stripe card. The data display device 37 is constituted by fluorescent displays and the like and displays, for example, data read by the card reader 36 or data input by the player through the key pad 38. The key pad 38 is for inputting commands and data relating to issue of tickets and the like.

FIG. 3 is a schematic view illustrating the symbol rows drawn on the peripheral surfaces of the respective reels.

There are drawn 22 symbols each on the respective outer peripheral surfaces of the left reel 14L, the center reel 14C and the right reel 14R. The symbol rows drawn on the respective reels 14 are different from one another. Each symbol row is constituted by a combination of symbols "JACKPOT 7", "BLUE 7", "BELL", "CHERRY", "STRAWBERRY", "PLUM", "ORANGE" and "APPLE".

If three of any one of the symbols "JACKPOT 7", "BLUE7", "BELL", "CHERRY", "STRAWBERRY", "PLUM", "ORANGE" and "APPLE" are statically displayed along the winning line L, then a predetermined number of credits are added to the number of credits possessed by the player.

If the 1-BET button 26 or the maximum-BET button 27 is pushed and, thereafter, the spin button 23 is pushed to start a game, the symbol rows drawn on the respective reels 14 are displayed in a scrolling manner from the upper direction to the lower direction in the display windows 15, along with the rotation of the reels 14 and, after the elapse of a predetermined time period, they are statically displayed through the display windows 15, along with the stop of the rotation of the reels 14. Further, in cases where various types of winning combinations are pre-determined on the basis of respective combinations of symbols, if a combination of symbols corresponding to a winning combination is stopped along the winning line L, then a number of coins corresponding to the winning combination is added to the number of credits possessed by the player.

Figure 4:
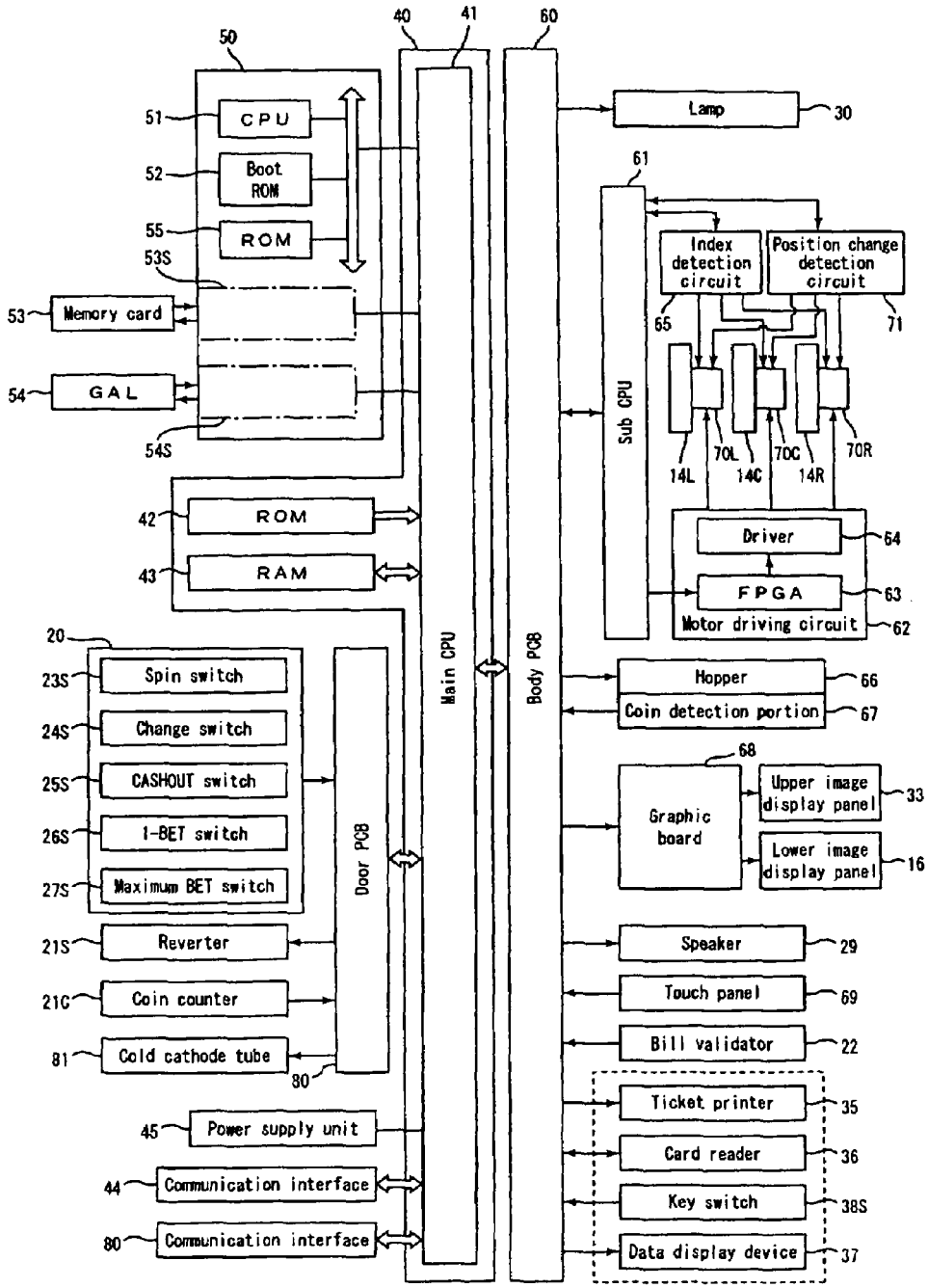
FIG. 4 is a block diagram illustrating the internal structure of the gaming machine according to the present embodiment.

FIG. 4 is a block diagram illustrating the internal structure of the gaming machine according to the present embodiment.

A gaming board 50 includes a CPU (Central Processing Unit) 51, a ROM 55 and a boot ROM 52, which are connected to one another through an internal bus, a card slot 53S compatible with a memory card 53, and an IC socket 54S compatible with a GAL (Generic Array Logic) 54.

The memory card 53 is constituted by a nonvolatile memory such as Compact Flash (registered trade mark) and the like and stores game programs and game system programs. The game programs include a lottery program. The aforementioned lottery program is a program for determining symbols (code Nos. corresponding to the symbols) on the respective reels 14 to be statically displayed along the winning line L. The aforementioned lottery program includes symbol weighing data associated with respective plural types of payout ratios (for example, 80%, 84% and 88%). The symbol weighing data are data indicating correspondence between the code Nos. of the respective symbols on the three reels 14 and one or plural random numbers which belong to a predetermined numerical value range (0 to 256). The payout ratio is determined on the basis of payout-ratio setting data output from the GAL 54, and lotteries are conducted on the basis of the symbol weighing data corresponding to this payout ratio.

Further, the card slot 53S is configured to enable inserting the memory card 53 thereinto and ejecting the memory card 53 therefrom, and is connected to a motherboard 40 through an IDE bus. Accordingly, by ejecting the memory card 53 from the card slot 53S, then writing different game programs and different game system programs into the memory card 53 and inserting the memory card 53 into the card slot 53S, it is possible to change the types and the contents of games to be played in the gaming machine 10. Also, by replacing a memory card 53 storing a single game program and a single game system program with another memory card 53 storing a different game program and a different game system program, it is possible to change the types and the contents of games to be played in the gaming machine 10. The game programs include programs relating to proceeding of games and image data and sound data to be output during games.

The GAL 54 is a type of PLD having an OR fixed array structure. The GAL 54 includes plural input ports and output ports and, if predetermined data is input to an input port thereof, the GAL 54 outputs data corresponding to this data from an output port thereof. The data output from this output port is the aforementioned payout-ratio setting data.

Further, the IC socket 54S is configured to enable attaching and detaching the GAL 54 thereto and therefrom and is connected to the motherboard 40 through a PCI bus. Accordingly, by detaching the GAL 54 from the IC socket 54S, then rewriting the programs stored in the GAL 54 and attaching the GAL 54 to the IC socket 54S, it is possible to change the payout-ratio setting ration to be output from the GAL 54. Also, by replacing the GAL 54 with another GAL 54, it is possible to change the payout-ratio setting data.

The CPU 51, the ROM 55 and the boot ROM 52, which are connected to one another through the internal bus, are connected to the motherboard 40 through PCI bus. The PCI bus transfers signals between the motherboard 40 and the gaming board 50 and also supplies electric power from the motherboard 40 to the gaming board 50. The ROM 55 stores country identification information and authentication programs. The boot ROM 52 stores pre-authentication programs, programs (boot codes) for causing the CPU 51 to activate the pre-authentication programs, and the like.

The authentication programs are programs for authenticating game programs and game system programs (falsification check programs). The authentication programs are described according to the procedure (authentication procedure) for confirming and certifying that game programs and game system programs which are objects of an authentication acquisition processing have not been falsified, i.e., according to the procedure for authenticating the game programs and game system programs. The pre-authentication programs are programs for authenticating the aforementioned authentication programs. The pre-authentication programs are described according to procedure (authentication procedure) for certifying that the authentication programs which are objects of an authentication processing have not been falsified, i.e., according to the procedure for authenticating the authentication programs.

The motherboard 40 is constituted by a commercial general-purpose mother board (a printed circuit board with basic components of a personal computer mounted thereon) and includes a gaming-machine controlling main CPU 41, a ROM (Read Only Memory) 42, a RAM (Random Access Memory) 43, a communication interface 44 and a communication interface 80. In the figure, the gaming-machine controlling main CPU 41 is simply illustrated as a main CPU 41.

The ROM 42 is constituted by a memory device, such as a flash memory, and stores programs such as a BIOS (Basic Input/Output System) to be executed by the gaming-machine controlling main CPU 41 and permanent data. If the gaming-machine controlling main CPU 41 executes the BIOS, the BIOS conducts processing for initializing predetermined peripheral devices and starts processing for taking in game programs and game system programs stored in the memory card 53, through the gaming board 50.

Further, the ROM 42 stores data about the number of bonus games to be executed in a return mode. The return mode indicates a state of games where a return is being performed for a player who has consumed a greater number of coins (refer to step S15 in FIG. 5 and step S22 in FIG. 1). In the present embodiment, the shift to the return mode occurs if the cumulative number of games has reached a predetermined upper limit value. Numbers of bonus games to be generated in the return mode are preliminarily determined in association with upper limits of predetermined cumulative number of games, wherein these upper limits are defined in a stepwise manner. Namely, the ROM 42 stores correspondence between the upper limits of the cumulative number of games and the numbers of bonus games.

Further, in the present invention, the ROM 42 can be either rewritable or non-rewritable.

The RAM 43 stores data and programs for use in operations of the gaming-machine controlling main CPU 41. Particularly, the RAM 43 stores cumulative numbers of games which are to be the basis for determining whether or not the game should shift to the return mode. Further, the RAM 43 can store authentication programs, game programs and game system programs which are read through the gaming board 50.

The communication interface 44 is for communicating with a server 200 through a communication line 101, when the gaming machine 10 is connected to the network as will be described later. Every time a single game is played, the gaming-machine controlling main CPU 41 transmits the number of inserted coins and the number of paid-out coins in that game to the server 200, along with the gaming-machine identification number of the gaming machine 10. The server 200 stores the cumulative number of games, the cumulative number of inserted coins and the cumulative number of paid-out coins, in association with each gaming-machine identification number.

In the first embodiment and the second embodiment of the present invention, the communication interface 80 intermediates between the gaming machine 10 and the ceiling notification device 300 in communication therebetween, when the gaming machine 10 is not connected to the network. The communication between the gaming machine 10 and the ceiling notification device 300 means transmission and reception of trigger signals (the first embodiment) or request signals and game data (the second embodiment). Trigger signals will be described later with reference to FIG. 6, while request signals and game data will be described later with reference to FIG. 13.

Further, a main-body PCB (Printed Circuit Board) 60 and a door PCB 80, which will be described later, are connected to the motherboard 40, through respective USBs. Further, a power supply unit 45 is connected to the motherboard 40. If electric power is supplied from the power supply unit 45 to the mother board 40, this activates the gaming-machine controlling main CPU 41 in the mother board 40 and also supplies electric power to the gaming board 50 through the PCI bus, thereby activating the CPU 51.

Apparatuses and devices for generating input signals to be input to the gaming-machine controlling main CPU 41 and apparatuses and devices to be operated under control of control signals output from the gaming-machine controlling main CPU 41 are connected to the main body PCB 60 and to the door PCB 80. The gaming-machine controlling main CPU 41 executes game programs and game system programs stored in the RAM 43, on the basis of input signals input to the gaming-machine controlling main CPU 41, for conducting predetermined calculation processing and storing the result thereof in the RAM 43 or for transmitting control signals to respective apparatuses and devices as processing for controlling the respective apparatuses and devices.

A lamp 30, a sub CPU 61, a hopper 66, a coin detecting portion 67, a graphic board 68, the speaker 29 as an output device, the touch panel 69, the bill validator 22, the ticket printer 35, the card reader 36, a key switch 38S and the data display device 37 are connected to the main body PCB 60. The lamp 30 is lighted in a predetermined pattern, on the basis of control signals output from the gaming-machine controlling main CPU 41.

The sub CPU 61 controls the rotation and the stop of the reels 14 (14L, 14C and 14R). A motor driving circuit 62 including an FPGA (Field Programmable Gate Array) 63 and a driver 64 is connected to the sub CPU 61. The FPGA 63 is an electronic circuit such as a programmable LSI and functions as the control circuit for stepping motors 70. The driver 64 functions as a circuit for amplifying pulses to be input to the stepping motors 70. The stepping motors 70 (70L, 70C and 70R) for rotating the respective reels 14 are connected to the motor driving circuit 62. The stepping motors 70 are one-two phase excitation stepping motors.

In the present invention, there is no particular limitation on the way of exciting the stepping motors, but it is also possible to employ a two-phase excitation method, a single-phase excitation method and the like. Also, instead of stepping motors, it is possible to employ DC motors. In the case of employing DC motors, a deviation counter, a D/A converter and a servo amplifier are connected in this order to the sub CPU 61, and the DC motors are connected to the servo amplifier. Further, rotary encoders detect the rotational positions of the DC motors and supply, as data, the current rotational positions of the DC motors to the deviation counter.

Further, an index detection circuit 65 and a position change detection circuit 71 are connected to the sub CPU 61. The index detection circuit 65 detects the positions of the reels 14 being rotated and is capable of detecting loss of synchronism of the reels 14.

The position change detection circuit 71 detects the change of the stop positions of the reels 14, after the stop of the rotation of the reels 14. For example, the position change detection circuit 71 detects the change of the stop positions of the reels 14, in an event such as an event in which a player forcibly changes the stop positions of the reels 14 to create a combination of symbols in a winning state, even through no winning state in the combination of symbols has actually occurred. For example, the position change detection circuit 71 may be structured to detect fins (not illustrated) mounted to the inner sides of the reels 14 at predetermined intervals so that the change of the stop positions of the reels 14 can be detected.

The hopper 66 is installed inside the cabinet 11 and pays out a predetermined number of coins from a coin payout port 19 to a coin tray 18, on the basis of control signals output from the gaming-machine controlling main CPU 41. The coin detection portion 67 is provided inside the coin payout port 19 and outputs input signals to the gaming-machine controlling main CPU 41 if it detects a predetermined number of coins being paid out from the coin payout port 19.

The graphic board 68 controls the display of images to the upper image display panel 33 and the lower image display panel 16 as the output device, on the basis of control signals output from the gaming-machine controlling main CPU 41. The number-of-credits display section 32 in the lower image display panel 16 displays the number of credits stored in the RAM 43. The number-of-payouts display section 31 in the lower image display panel 16 displays the number of coins to be paid out.

The graphic board 68 includes a VDP (Video Display Processor) for creating image data on the basis of control signals output from the gaming-machine controlling main CPU 41, a video RAM for temporarily storing image data created by the VDP, and the like. Game programs read from the memory card 53 and stored in the RAM 43 include image data for use in creating image data with the VDP.

The bill validator 22 identifies whether or not bills are valid and receives valid bills and introduces them into the cabinet 11. When receiving valid bills, the bill validator 22 outputs input signals to the gaming-machine controlling main CPU 41, on the basis of the value of the bills. The gaming-machine controlling main CPU 41 stores, in the RAM 43, a number of credits corresponding to the value of bills transferred through the input signals.

The ticket printer 35 prints, onto a ticket, a barcode containing encoded data of the number of credits, time and date, the identification number of the gaming machine 10 and the like stored in the RAM 43, on the basis of control signals output from the gaming-machine controlling main CPU 41, and outputs the ticket as a ticket 39 with a barcode.

The card reader 36 reads data from a smart card and transmits the data to the gaming-machine controlling main CPU 41 and also writes data into a smart card on the basis of control signals from the gaming-machine controlling main CPU 41. The key switch 38S is provided in the key pad 38 and, if a player operates the key pad 38, outputs predetermined input signals to the gaming-machine controlling main CPU 41. The data display device 37 displays data read by the card reader 36 or data input through the key pad 38 by the player, on the basis of the control signals output from the gaming-machine controlling main CPU 41.

The control panel 20, a reverter 21S, a coin counter 21C and a cold-cathode tube 81 are connected to the door PCB 80. In the control panel 20, there are provided a spin switch 23S associated with the spin button 23, a change switch 24S associated with the change switch 24, a CASHOUT switch 25S associated with the CASHOUT button 25, a 1-BET switch 26S associated with the 1-BET button 26 and a maximum-BET switch 27S associated with the maximum BET button 27. The respective switches 23S to 27S output input signals to the gaming-machine controlling main CPU 41, if the player operates the corresponding buttons 23 to 27.

The coin counter 21C is provided inside the coin receiving port 21 and identifies whether or not coins that the player inserted into the coin receiving port 21 are valid. Coins other than valid coins are discharged from the coin payout port 19. Further, the coin counter 21C outputs input signals to the gaming-machine controlling main CPU 41, if it detects valid coins.

The reverter 21S operates on the basis of control signals output from the gaming-machine controlling main CPU 41 and sorts coins determined to be valid coins by the coin counter 21C into a cash box (not illustrated) or the hopper 66 installed inside the gaming machine 10. Namely, when the hopper 66 is filled with coins, the reverter 21S transfers the valid coins to the cash box. On the other hand, when the hopper 66 is not filled with coins, the reverter 21S transfers valid coins to the hopper 66. The cold-cathode tube 81 functions as back lights installed on the back surfaces of the lower image display panel 16 and the upper image display panel 33 and is lighted on the basis of control signals output from the gaming-machine controlling main CPU 41.

Figure 5:
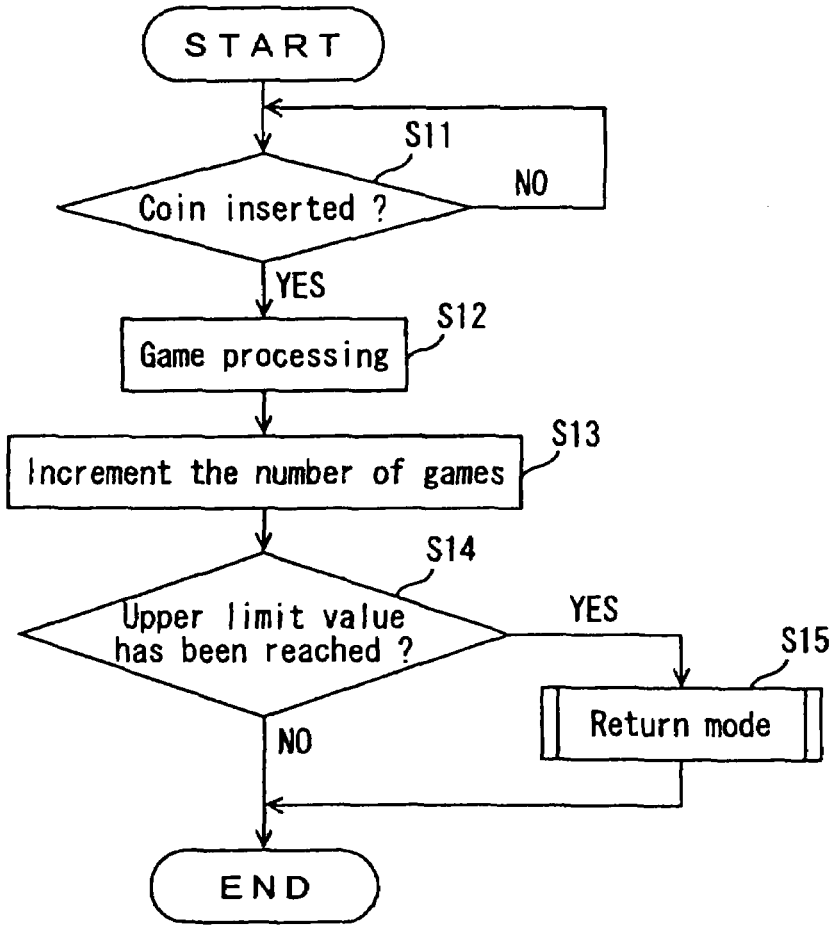
FIG. 5 is a flow chart illustrating processing in the gaming machine according to the present embodiment.

FIG. 5 is a flow chart illustrating processing in the gaming machine according to the present embodiment.

At first, at step S11, the gaming-machine controlling main CPU 41 determines whether or not a player has inserted coins, on the basis of signals from the coin counter 21C. If the gaming-machine controlling main CPU 41 determines that no coin has been inserted (step S11: NO), the gaming-machine controlling main CPU 41 waits for coins to be inserted. On the other hand, if the gaming-machine controlling main CPU 41 determines that coins have been inserted (step S11: YES), the gaming-machine controlling main CPU 41 proceeds to step S12.

At step S12, the gaming-machine controlling main CPU 41 conducts a series of processing relating to games to be played in the gaming machine 10, i.e., the slot machine. More specifically, the gaming-machine controlling main CPU 41 causes the rotation and the stop of the reels and also performs determination (winning determination) of whether or not the resultant combination of symbols corresponds to respective types of winning combinations and, if a winning occurs, pays out coins, according to the winning combination.

Next, at step S13, the gaming-machine controlling main CPU 41 increments the cumulative number of games stored in the RAM 43.

Next, at step S14, the gaming-machine controlling main CPU 41 determines whether or not the cumulative number of games stored in the RAM 43 has reached a predetermined upper limit value stored in the ROM 42. If the gaming-machine controlling main CPU 41 determines that the cumulative number of games has reached the predetermined upper limit value (step S14: YES), the gaming-machine controlling main CPU 41 proceeds to step S15.

At step S15, the gaming-machine controlling main CPU 41 conducts processing relating to the return mode (see FIG. 1). In the present embodiment, bonus games are generated in the return mode. Such bonus games are free games (games which a player can play a predetermined number of times, without betting coins).

If the gaming-machine controlling main CPU 41 determines that the cumulative number of games has not reached the predetermined upper limit value (step S14: NO) or after conducting the processing relating to the return mode at step S15, the gaming-machine controlling main CPU 41 ends the present subroutine.

While there has been described the gaming machine 10 according to the present embodiment, it has been merely described as a concrete example, not described to restrict the present invention.

For example, while, in the present embodiment, there are 22 symbols drawn on the outer peripheral surfaces of each of the reels, and the symbol row drawn on each reel 14 is constituted by a combination of symbols "JACKPOT 7", "BLUE 7", "BELL", "CHERRY", "STRAWBERRY", "PLUM", "ORANGE" and "APPLE", the present invention is not limited thereto, and it is possible to change the types and the number of used symbols, as required. Further, while, in the present embodiment, the reels are rotated for creating combinations of symbols, the method for creating combinations of symbols is not limited thereto, but a symbol matrix can be displayed to the lower image display panel 16, and symbols can be rearranged within this symbol matrix, for example.

Furthermore, in the present invention, the gaming machine 10 is not limited to a slot machine. The gaming machine can be a so-called single gaming machine such as a video slot machine, a video card gaming machine or a so-called mass gaming machine (multi-terminal gaming machine) which executes games such as horse racing games, bingo games and lotteries, which require a predetermined time period to display results.

While, in the present embodiment, shift to the return mode occurs if the cumulative number of games reaches a predetermined upper limit value, the present invention is not limited to the case. For example, shift to the return mode can occur if the cumulative number of BETs reaches a predetermined upper limit value. Also, in cases where the payment balance of a player has a negative value, namely in cases where the total sum of the numbers of betted coins minus the total sum of the numbers of paid-out coins has a negative value, shift to the return mode can occur if the negative value reaches a predetermined value. Also, in cases where the player plays games using a ticket 39 with a barcode or a smart card, the timing of shift to the return mode can be determined by referring to the game history stored in the ticket 39 with a barcode or the smart card. Namely, there is no restriction on the timing of shift to the return mode, as long as such timing is based on a state where it can be evaluated that the player has consumed more than a certain number of coins.

Further, while, in the present embodiment, bonus games are generated in the return mode, the present invention is not limited to the case. Namely, there is no particular limitation on the game state which occurs in the return mode, and the game state which occurs in the return mode can be a state where a player can acquire a greater number of coins than in a normal game state, a state where a player can acquire coins with higher probabilities than in a normal game state, a state which enables a player to consume a smaller number of coins than in a normal game state, and the like. More specifically, examples thereof include second games, mystery bonuses and the like, as well as bonus games. Also, a predetermined number of coins can be paid out to the player, in the return mode. Namely, there is no particular limitation on the game state which occurs in the return mode, but it is possible to design and change the game state as required, as long as such a game state is advantageous to the player.

Further, while, in the present embodiment, numbers of bonus games to be generated in the return mode are defined in advance in association with stepwise-defined predetermined upper limits of cumulative number of games, the present invention is not limited to the case. For example, only a single upper limit of cumulative number of games can be defined and, every time the cumulative number of games has reached the upper limit, the cumulative number of games can be reset.

Hereinafter, there will be described two embodiments of the ceiling notification device 300.

First Embodiment

Figure 6:
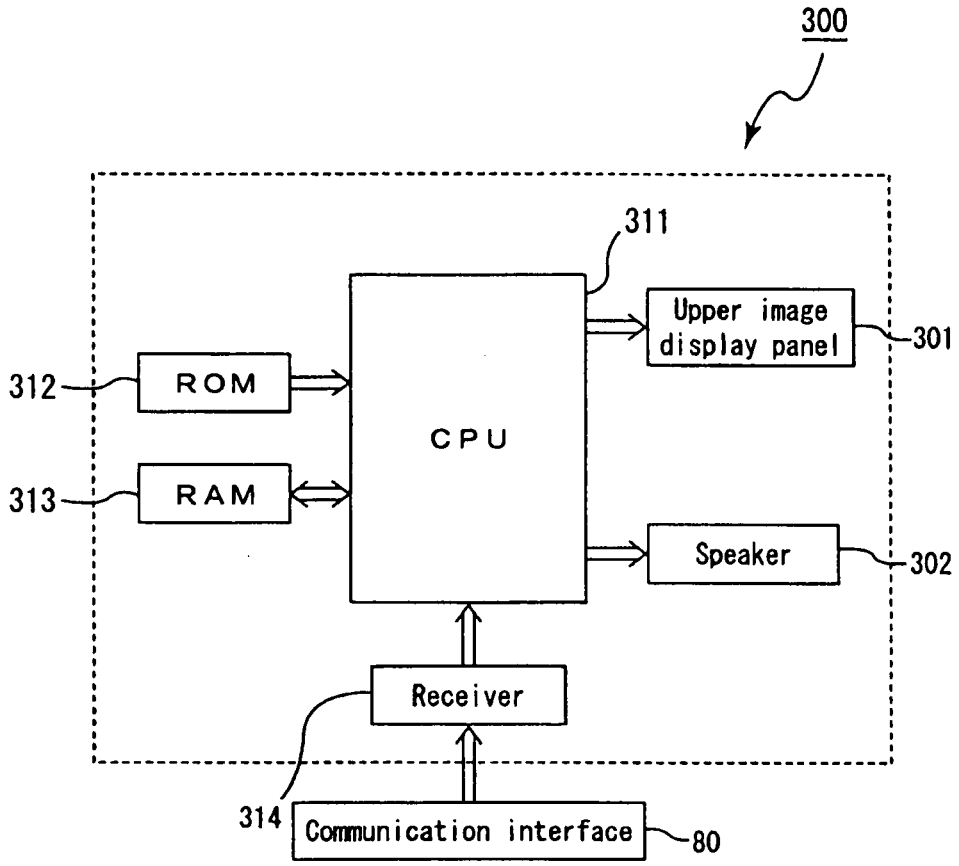
FIG. 6 is a block diagram illustrating the internal structure of the ceiling notification device according to the first embodiment of the present invention.

FIG. 6 is a block diagram illustrating the internal structure of the ceiling notification device according to a first embodiment of the present invention.

The ceiling notification device 300 includes a ceiling-notification-device controlling CPU 311, a ROM 312, a RAM 313, a receiver 314, the image display panel 301 and the speaker 302. In the figure, the ceiling-notification-device controlling CPU 311 is simply illustrated as a CPU 311.

The-ceiling-notification-device controlling CPU 311 conducts various types of processing, in order to output appropriate images and sounds to the image display panel 301 and the speaker 302, on the basis of trigger signals supplied from the gaming-machine controlling main CPU 41 through the communication interface 80 and the receiver 314 and data and programs stored in the ROM 312 and the RAM 313. The-ceiling-notification-device controlling CPU 311 corresponds to a controller according to the present invention.

The ROM 312 is constituted by, for example, a semiconductor memory and the like and stores programs for realizing basic functions of the ceiling notification device 300, programs for announcing timing of maintenances and for setting and managing conditions to be announced, and the like. More specifically, in the present embodiment, the ROM 312 stores plural types of output data. The output data is data to be referred in outputting images and sounds to the image display panel 301 and the speaker 302. The ROM 312 corresponds to a memory according to the present invention.

The RAM 313 temporarily stores data and the like relating to the results of processing that the ceiling-notification-device controlling CPU 311 conducted, in outputting images and sounds to the image display panel 301 and the speaker 302.

The receiver 314 receives trigger signals transmitted from the gaming-machine controlling main CPU 41 through the communication interface 80 and transmits the trigger signals to the ceiling-notification-device controlling CPU 311. The trigger signals are signals indicative of the occurrence of shift to the return mode. In the present embodiment, a trigger signal is transmitted in the event of the occurrence of shift to the return mode since the cumulative number of games has reached a predetermined upper limit value. Such a trigger signal includes information (specification information) which specifies single output data corresponding to the game state, out of the aforementioned plural types of output data. In the present embodiment, more specifically, the specification information refers to information about the upper limit value based on which the shift to the return mode has occurred, out of the plural stepwise-defined upper limit values.

Figure 7:
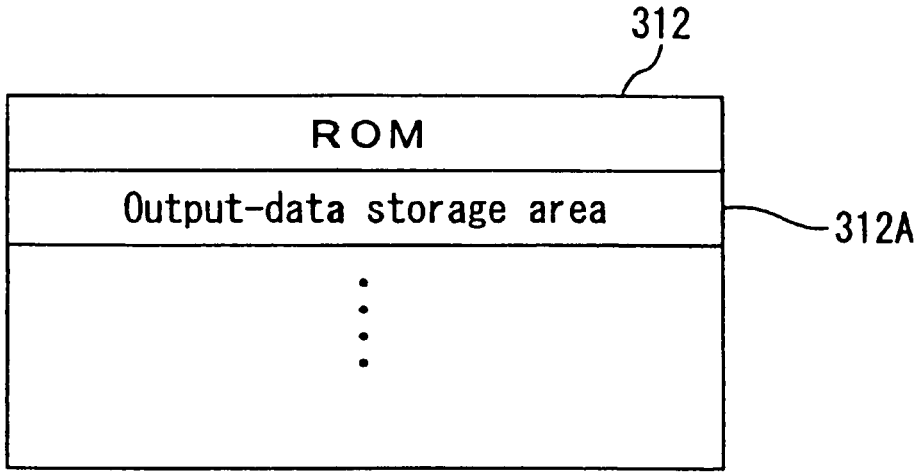
FIG. 7 is a view illustrating the storage area of the ROM in the ceiling notification device.

FIG. 7 is a view illustrating the storage area of the ROM in the ceiling notification device.

As illustrated in FIG. 7, the ROM 312 is provided with an output-data storage area 312A. The output-data storage area 312A stores the aforementioned output data, namely the data to be referred to in outputting images and sounds to the image display panel 301 and the speaker 302.

FIG. 8 is a view illustrating an exemplary image which is displayed on the image display panel.

There are plural types of images which can be displayed to the image display panel 301, and a single image is selected out of them and displayed to the image display panel, as will be described hereinafter. Namely, a single image to be displayed is selected, on the basis of the single output data extracted from the ROM 312 according to the aforementioned specification information (in the present embodiment, information about fact on which of the plural stepwise-defined upper limit values occurrence of the shift to the return mode was based on) included in the trigger signal. Accordingly, to the image display panel 301, information about the cumulative number of games which triggered the generation of bonus games is displayed. For example, in the example illustrated in FIG. 8, there is displayed the fact that bonus games are being generated and, also, the generation of these bonus games is caused since the cumulative number of games has reached 100.

Further, the images to be displayed to the image display panel 301 are not limited to the case. For example, the number of bonus games which have been generated can be displayed and, also, the number of remaining bonus games can be displayed thereto along with proceeding of bonus games. Namely, it is possible to design and change, as required, the images to be displayed to the image display panel 301, as long as they have contents indicating which benefit state is being generated for the player in the return mode.

Next, with reference to FIG. 1, there will be described processing in the gaming machine and the ceiling notification device according to the first embodiment of the present invention.

First, the processing in the gaming machine will be described.

In the event of the occurrence of shift to the return mode since it is determined at step S14 in FIG. 5 that the cumulative number of games has reached a predetermined upper limit value (step S14: YES), the gaming-machine controlling main CPU 41 transmits a trigger signal (a signal indicative of the occurrence of shift to the return mode) to the ceiling-notification-device controlling CPU 311, through the communication interface 80 and the receiver 314, at step S21. At this time, the gaming-machine controlling main CPU 41 includes, in the trigger signal, the aforementioned specification information (information about the fact on which of the plural stepwise-defined upper limit values occurrence of the shift to the return mode was based on), by referring to the information about the cumulative number of games stored in the RAM 43.

Next, at step S22, the gaming-machine controlling main CPU 41 conducts return processing, namely processing relating to bonus games in the return mode. More specifically, the gaming-machine controlling main CPU 41 conducts game processing described in the description for step S12 in FIG. 5, without waiting for coins being inserted.

After executing the processing at step S22, the gaming-machine controlling main CPU 41 ends the present subroutine.

Subsequently, the processing in the ceiling notification device of FIG. 1 will be described.

First, at step S101, the ceiling-notification-device controlling CPU 311 receives the trigger signal transmitted from the gaming-machine controlling main CPU 41 at step S21, through the communication interface 80 and the receiver 314.

Next, at step S102, the ceiling-notification-device controlling CPU 311 extracts, from the output-data storage area 312A of the ROM 312, the aforementioned output data (the data to be referred to in outputting images and sounds to the image display panel 301 and the speaker 302) corresponding to the aforementioned specification information (the information about the fact on which of the plural stepwise-defined upper limit values occurrence of the shift to the return mode was based on) included in the trigger signal received at step S101.

Next, at step S103, the ceiling-notification-device controlling CPU 311 causes the image display panel 301 and the speaker 302 to output images and sounds, respectively, on the basis of the output data extracted at step S102.

After executing the processing at step S103, the ceiling-notification-device controlling CPU 311 ends the present subroutine.

There has been described a stand-alone type slot machine which is not connected to a network, as the gaming machine 10 according to the first embodiment of the present invention. However, the first embodiment of the present invention is applicable to cases where the gaming machine 10 is connected to a network. Hereinafter, there will be described a case where the gaming machine 10 is connected to a network; the description will mainly focus on points different from the case where the gaming machine is not connected to a network.

Figure 9:
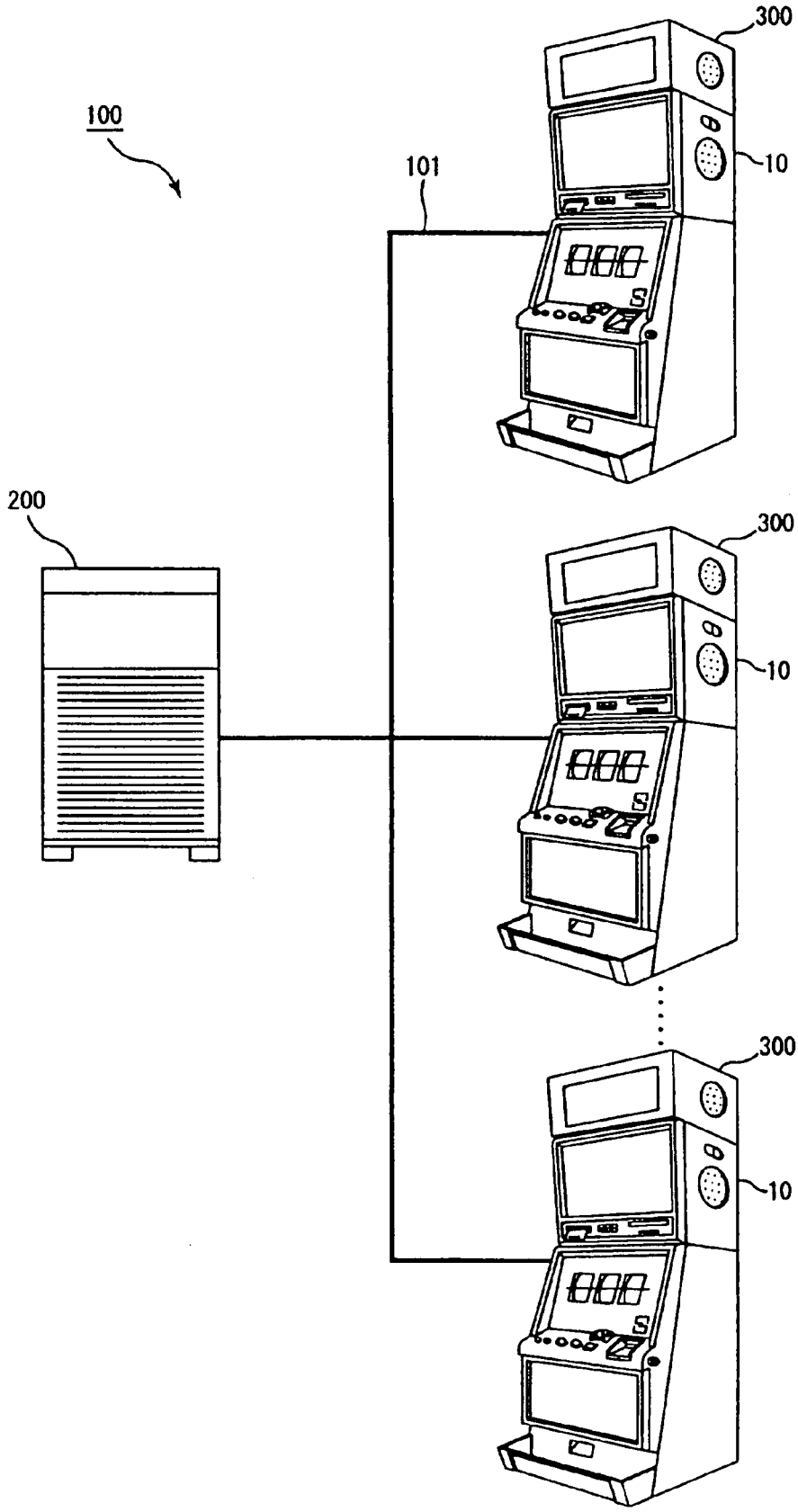
FIG. 9 is a schematic view illustrating the entire structure of a gaming system according to an embodiment of the present invention.

FIG. 9 is a schematic view illustrating the entire structure of a gaming system according to an embodiment of the present invention.

The gaming system 100 includes plural gaming machines 10, plural ceiling notification devices 300 installed at the upper portions of the respective gaming machines 10, and a server 200 connected to these gaming machines 10 and these ceiling notification devices 300 through predetermined communication lines 101. This gaming system 100 can either be structured within a single game facility which can offer various types of games, such as a bar and a casino, or can be structured among plural gaming facilities. Also, in the case where the gaming system 100 is structured within a single game facility, the gaming system 100 can be structured on each floor or in each section in this game facility. There is no particular limitation on the communication lines 101, but the communication lines 101 can be of a wired type or a wireless type and can be dedicated lines or switched lines and the like.

The server 200 controls the plural gaming machines 10 and the plural ceiling notification devices 300. The gaming machines 10 are provided with respective specific identification numbers, and the server 200 identifies the source of data transmitted from the respective gaming machines 10 or the respective ceiling notification devices 300, on the basis of these identification numbers. Further, in cases where the server 200 transmits data to the gaming machines 10 or the respective ceiling notification devices 300, the server 200 specifies the transmission destination thereof, using the identification number.

The identification numbers of the gaming machines correspond to identification information according to the present invention. In the present invention, there is no particular limitation on the identification information of the gaming machines, but it is possible to employ, for example, characters, symbols, numerical characters, and combinations thereof.

Figure 10:
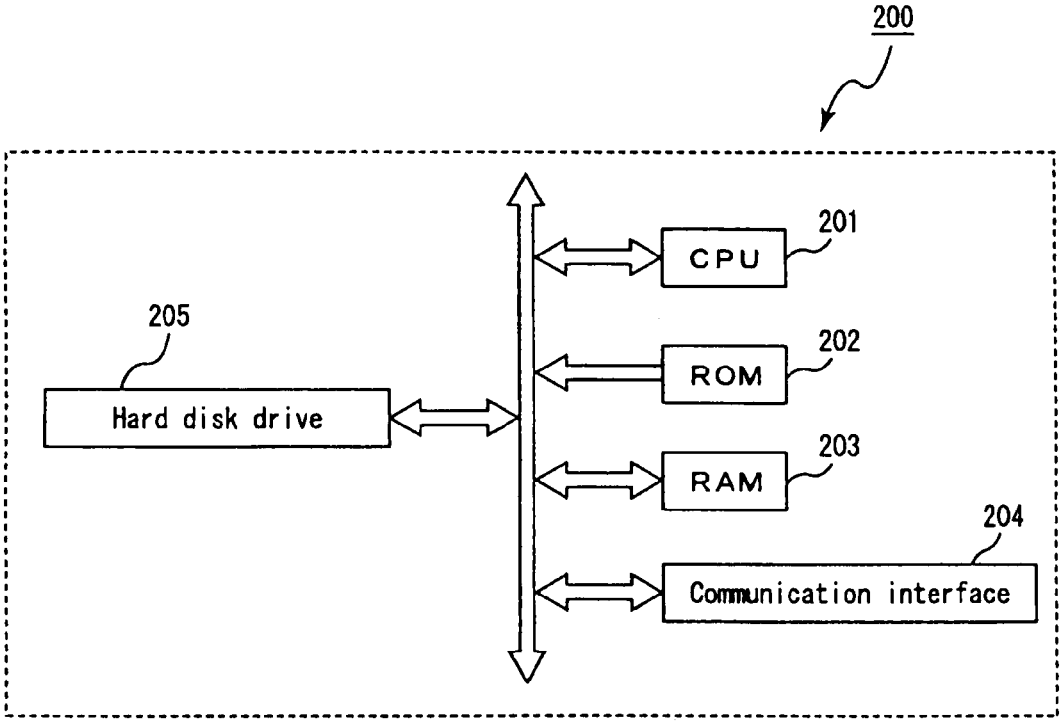
FIG. 10 is a block diagram illustrating the internal structure of a server according to an embodiment of the present invention.

FIG. 10 is a block diagram illustrating the internal structure of the server according to an embodiment of the present invention.

The server 200 includes a CPU 201 as an operation processing device (hereinafter, also referred to as "server-controlling CPU 201"), a ROM 202, a RAM 203 as a temporal storage device, a communication interface 204 and a hard disk drive 205. The communication interface 204 is connected to the communication interfaces 44 in the respective gaming machines 10 and the receivers 314 and transmitters 315 (refer to the second embodiment) in the ceiling notification devices 300, through the communication lines 101. The ROM 202 stores system programs and permanent data and the like for controlling the operations of the server. Further, the RAM 203 temporarily stores data received from the respective gaming machines 10 and the respective ceiling notification devices 300 and data of the results of operations and the like. Further, the hard disk drive 205 stores the game histories of the respective gaming machines 10, in association with the gaming-machine identification numbers of the respective gaming machines 10. Further, the hard disk drive 205 stores the correspondence between upper limits of the cumulative number of games and the numbers of bonus games, as the ROM 42 in the gaming machine 10 which is not connected to the network.

Figure 11:
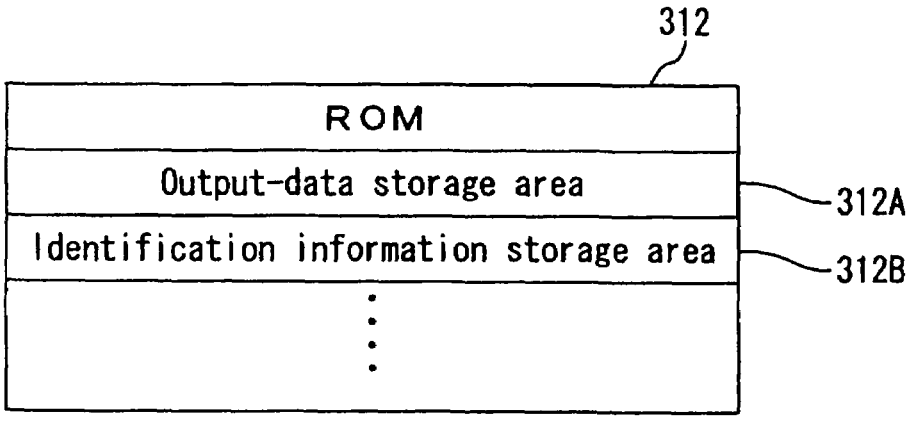
FIG. 11 is a view illustrating the storage area of the ROM in a ceiling notification device.

FIG. 11 is a view illustrating the storage area of the ROM in a ceiling notification device.

The ROM 312 is additionally provided with an identification-information storage area 312B, in the case where the gaming machines 10 are connected to a network, which is not the case when the gaming machines 10 are not connected to the network. The ROM 312 stores identification information which is information about the gaming-machine identification number applied to the gaming machine 10 installed in association with the ceiling notification device 300.

Figure 12:
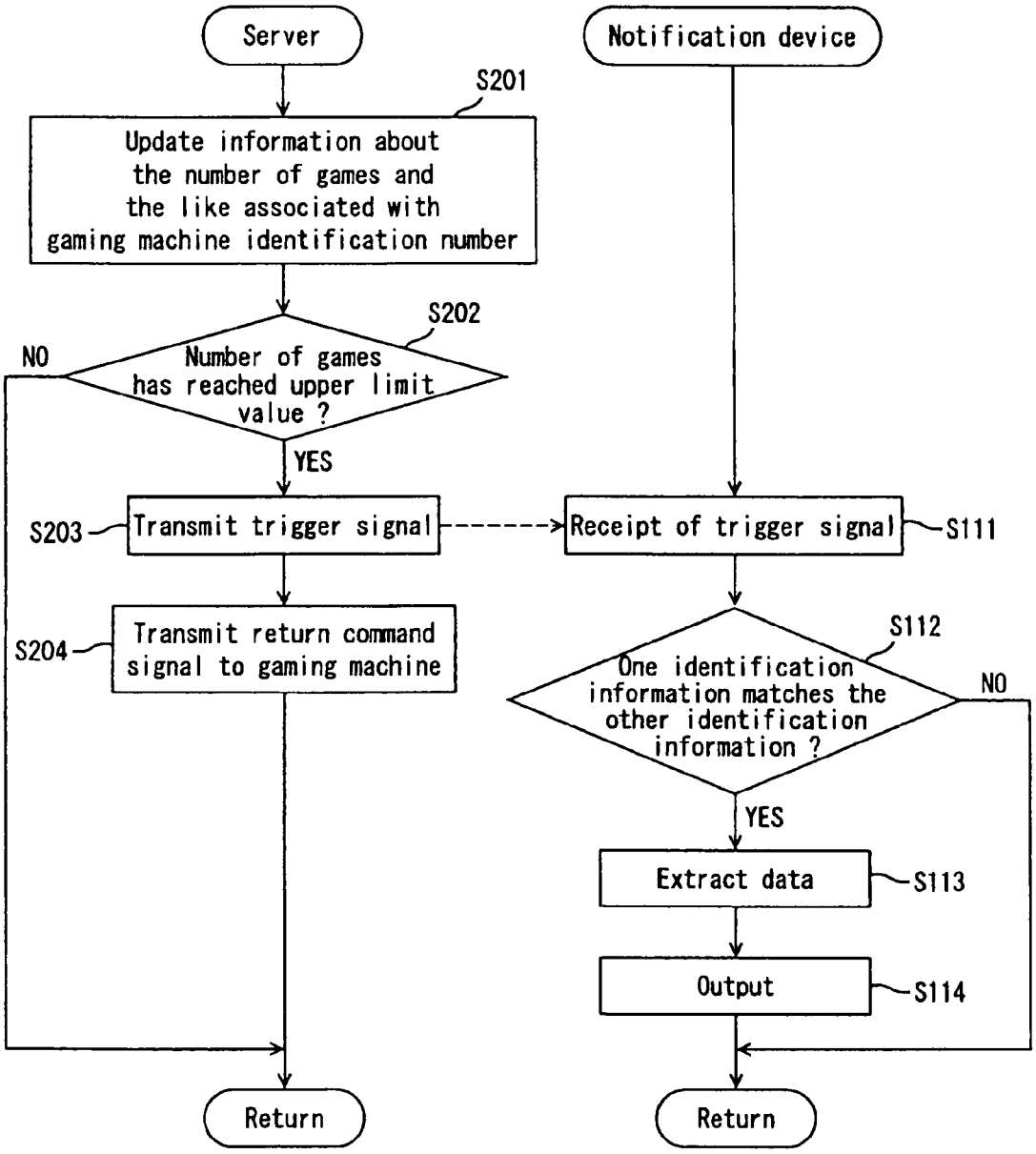
FIG. 12 is a flow chart illustrating processing in the server and in a ceiling notification device according to the first embodiment of the present invention.

FIG. 12 is a flow chart illustrating processing in the server and in a ceiling notification device according to a first embodiment of the present invention.

At first, the processing in the server will be described.

At first, every time a single game is ended in a slot machine, the server-controlling CPU 201 updates the information about the game history of each gaming machine 10, in association with the gaming-machine identification number (step S201). More specifically, in every game, the server-controlling CPU 201 receives a signal including information about the game history from the gaming-machine controlling main CPU 41 in each gaming machine 10 and updates the game-history information stored in the hard disk drive 205 on the basis of the signal.

Next, at step S202, the server-controlling CPU 201 determines whether or not there is a gaming machine 10 in which the cumulative number of games has reached a predetermined upper limit value, on the basis of the game-history information in the hard disk drive 205 which was updated at step S201 and the information about the upper limits of the cumulative number of games stored in the hard disk drive 205. If the server-controlling CPU 201 determines that there is a gaming machine 10 in which the cumulative number of games has reached a predetermined upper limit value (step S202: YES), the server-controlling CPU 201 proceeds to step S203.

At step S203, the server-controlling CPU 201 transmits a trigger signal to the ceiling-notification-device controlling CPU 311. The trigger signal includes identification information in addition to specification information, in the case where the gaming machine 10 is connected to the network, which is not the case when the gaming machine 10 is not connected to the network. The identification information included in the trigger signal is information about the gaming-machine identification number provided to the gaming machine 10 which has satisfied the condition required for causing the shift to the return mode. In the present embodiment, the identification information included in the trigger signal is information about the gaming machine identification number provided to the gaming machine 10 in which the cumulative number of games has reached a predetermined upper limit value.

Next, at step S204, the server-controlling CPU 201 transmits a return command signal to the gaming-machine controlling main CPU 41 in the gaming machine 10 in which the cumulative number of games has reached the predetermined upper limit value. On receiving the signal, the gaming-machine controlling main CPU 41 conducts the return processing described with respect to step S22 in FIG. 1.

If the server-controlling CPU 201 determines, at step S202, that there is no gaming machine 10 in which the cumulative number of games has reached a predetermined upper limit value (step S202: NO), or after conducting the processing at step S204, the server-controlling CPU 201 ends the present subroutine.

Subsequently, there will be described the processing in the ceiling notification device of FIG. 12.

At first, at step S111, the ceiling-notification-device controlling CPU 311 receives the trigger signal transmitted from the server-controlling CPU 201 at step S203, through the communication interface 204 and the receiver 314.

Next, at step S112, the ceiling-notification-device controlling CPU 311 determines whether or not the identification information included in the trigger signal received at step S111 (i.e., information about the gaming-machine identification number provided to the gaming machine 10 in which the cumulative number of games has reached the predetermined upper limit value) matches the identification information stored in the identification-information storage area 312B (i.e., information about the gaming machine identification number provided to the gaming machine 10 installed in association with the ceiling notification device 300). If the ceiling-notification-device controlling CPU 311 determines that the former identification information matches the latter identification information (step S112: YES), the ceiling-notification-device controlling CPU 311 proceeds to step S113.

At step S113, the ceiling-notification-device controlling CPU 311 extracts, from the output-data storage area 312A of the ROM 312, output data (data to be referred in outputting images and sounds to the image display panel 301 and the speaker 302) corresponding to the specification information (information about the fact on which of the plural stepwise-defined upper limit values occurrence of the shift to the return mode was based on) included in the trigger signal received at step S111.

Next, at step S114, the ceiling-notification-device controlling CPU 311 causes the image display panel 301 and the speaker 302 to output images and sounds, on the basis of the output data extracted at step S113.

If the ceiling-notification-device controlling CPU 311 determines at step S112 that the one identification information does not match the other identification information (step S112 NO), or after conducting the processing at step S114, the ceiling-notification-device controlling CPU 311 ends the present subroutine.

There has been described the first embodiment of the present invention.

Hereinafter, there will be described a second embodiment of the present invention. In the second embodiment, similarly to in the first embodiment, there are a state where the gaming machines 10 are connected to a network and a state where they are not connected to the network. Hereinafter, at first, there will be described the case where the gaming machines 10 are not connected to the network.

Second Embodiment

Figure 13:
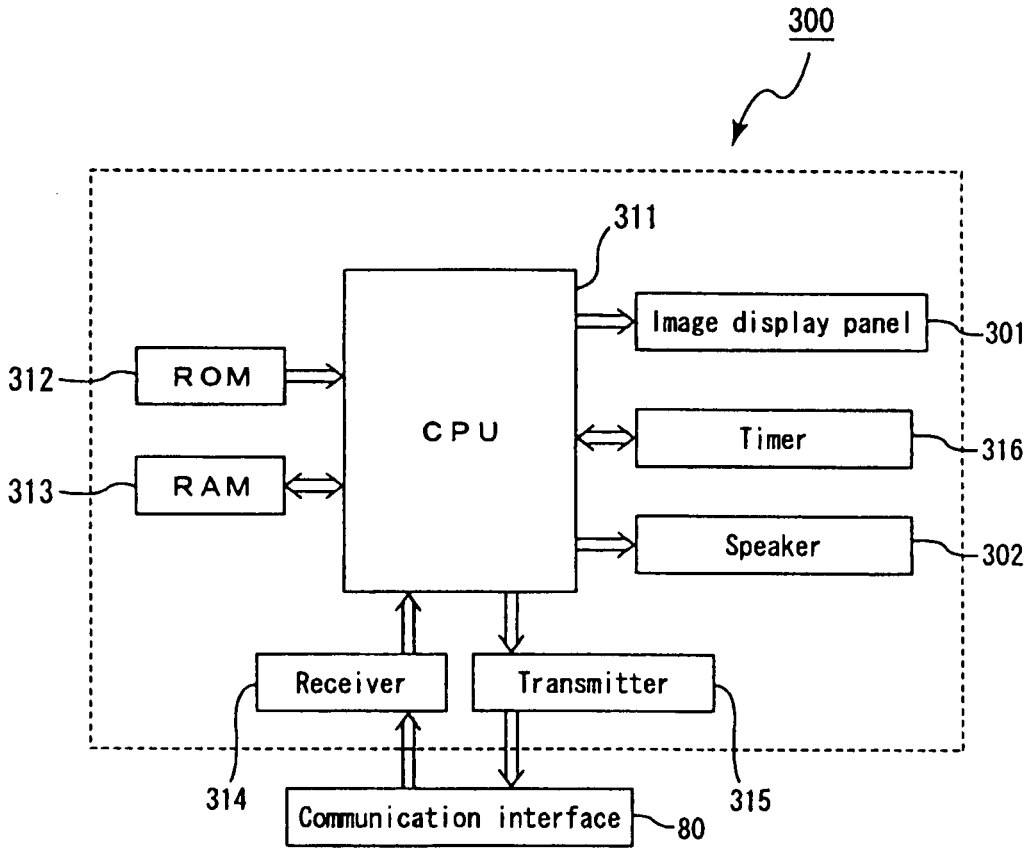
FIG. 13 is a block diagram illustrating the internal structure of a ceiling notification device according to a second embodiment of the present invention.

FIG. 13 is a block diagram illustrating the internal structure of a ceiling notification device according to a second embodiment of the present invention.

The ceiling notification device 300 includes a ceiling-notification-device controlling CPU 311, a ROM 312, a RAM 313, a receiver 314, a transmitter 315, a timer 316, an image display panel 301 and a speaker 302. Components having the same reference characters as those of the components illustrated in FIG. 2 and FIG. 6 have substantially the same basic functions as those described with reference to FIG. 2 and FIG. 6. The image display panel 301 and the speaker 302 are the same as those described with reference to FIG. 2, and the ceiling-notification-device controlling CPU 311, the ROM 312, and the RAM 313 are the same as those described with reference to FIG. 6; therefore, description thereof will be omitted herein. Further, the output-data storage area 312A provided in the ROM 312 is the same as that described with reference to FIG. 7. Hereinafter, there will be described the transmitter 315, the timer 316 and the receiver 314 which has functions slightly different from that of FIG. 6 (the first embodiment).

The transmitter 315 receives a request signal transmitted from the ceiling-notification-device controlling CPU 311 and transmits this signal to the gaming-machine controlling main CPU 41 through the communication interface 80. Such a request signal is a signal indicative of a request for transmission of game data in the gaming machine 10 installed in association with the ceiling notification device 300. The game data is data about games being played in this gaming machine 10, including the game histories of players.

The timer 316 performs time measurement. The timer 316 transmits time information to the ceiling-notification-device controlling CPU 311 and, then, the ceiling-notification-device controlling CPU 311 transmits a request signal on the basis of this time information.

The receiver 314 receives, through the communication interface 80, the aforementioned game data transmitted from the gaming-machine controlling main CPU 41 which received the aforementioned request signal. The receiver 314 transmits the received game data to the ceiling-notification-device controlling CPU 311.

FIG. 14 is a view illustrating an exemplary image which is displayed to the image display panel.

An image as illustrated in FIG. 14 is used to notify the player of information about the number of games required for generating bonus games in the return mode, namely, information about the number of coins to be consumed for causing the shift to the return mode.

However, the image to be displayed to the image display panel 301 is not limited to the case. For example, instead of directly displaying the number of remaining games until the shift to the return mode, it is also possible to display an index of the number of remaining games with colors (for example, by displaying a number of remaining games less than 10 with a red color and by displaying a number of remaining games equal to or more than 10 with a yellow color). Namely, there is no restriction on the display, provided that the display enables the player to estimate an approximate value of coins which should be consumed for causing a return.

Figure 15:
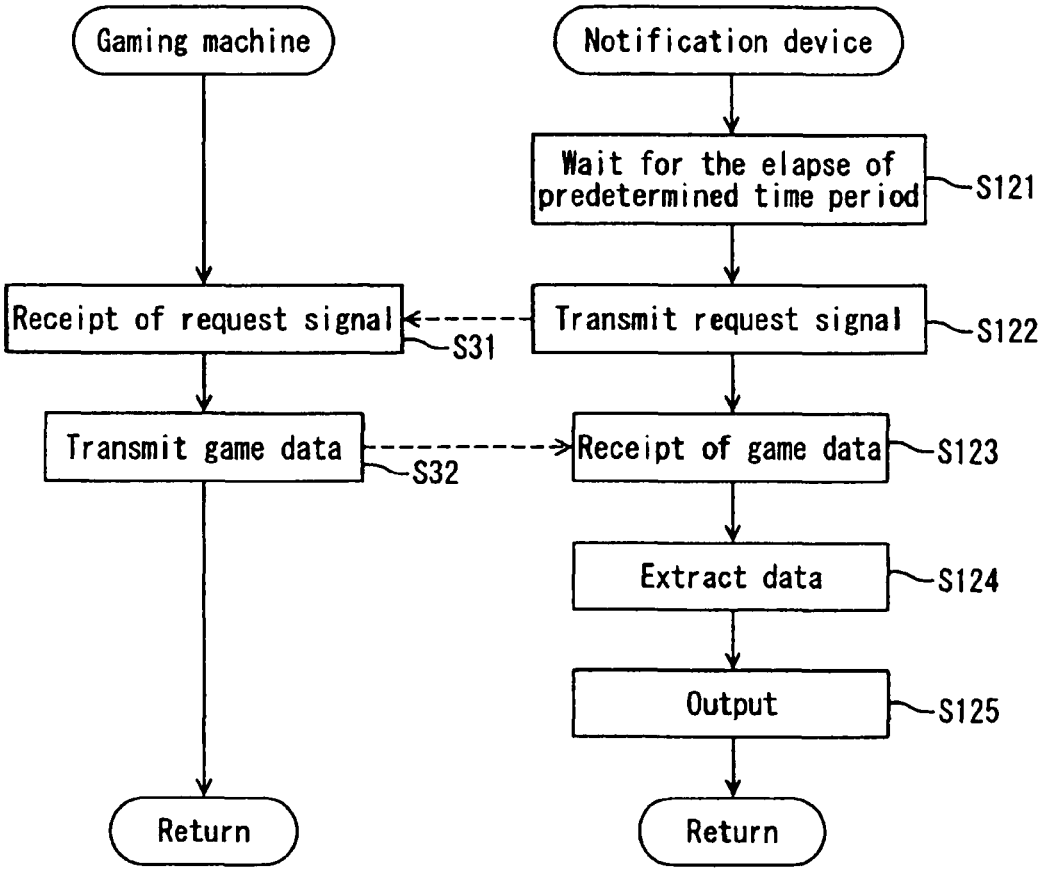
FIG. 15 is a flow chart illustrating processing in the gaming machine and in the ceiling notification device according to the second embodiment of the present invention.

FIG. 15 is a flow chart illustrating processing in a gaming machine and in a ceiling notification device according to a second embodiment of the present invention.

First, at step S121, the ceiling-notification-device controlling CPU 311 waits for the elapse of a predetermined time period, on the basis of time information from the timer 316. After the elapse of the predetermined time period, the ceiling-notification-device controlling CPU 311 proceeds to step S122.

At step S122, the ceiling-notification-device controlling CPU 311 transmits the aforementioned request signal (a signal indicative of a request for transmission of game data in the gaming machine 10 installed in association with the ceiling notification device 300) to the gaming-machine controlling main CPU 41.

While, in the present embodiment, a request signal is transmitted on condition that a predetermined time period has elapsed as described above, in the present invention, the timing of transmission of the request signal is not limited to the case. For example, a request signal can be transmitted at random instead of defining a predetermined time period in advance, or the timing of transmission of a request signal can be varied by referring to the previously-received game data.

The gaming-machine controlling main CPU 41 receives this request signal through the transmitter 315 and the communication interface 80, at step S31.

Subsequently, at step S32, the gaming-machine controlling main CPU 41 transmits the aforementioned game data (data about games being played in this gaming machine 10, including the game histories of players). The ceiling-notification-device controlling CPU 311 receives this game data through the communication interface 80 and the receiver 314, at step S123.

Next, at step S124, the ceiling-notification-device controlling CPU 311 extracts output data (data to be referred to in outputting images and sounds to the image display panel 301 and the speaker 302), from the output-data storage area 312A of the ROM 312, on the basis of the game data received at step S123.

Next, at step S125, the ceiling-notification-device controlling CPU 311 causes the image display panel 301 and the speaker 302 to output images and sounds, on the basis of the output data extracted at step S124.

After conducting the processing at step S125, the ceiling-notification-device controlling CPU 311 ends the present subroutine.

There has been described the case where the gaming machine 10 is not connected to the network, according to the second embodiment of the present invention. Hereinafter, there will be described a case where the gaming machine 10 is connected to the network.

The ceiling notification device has an internal structure substantially the same as that described with reference to FIG. 13. However, in the case where the gaming machine 10 is connected to the network, the receiver 314 and the transmitter 315 transmit and receive signals to and from the server-controlling CPU 201 through the communication interface 204, while they transmit and receive signals to and from the gaming-machine controlling main CPU 41 through the communication interface 80 in the case where the gaming machine 10 is not connected to the network. Further, in the storage area of the ROM 312, there is provided an identification-information storage area 312B in addition to the output-data storage area 312A, as described with reference to FIG. 11 (the case where the gaming machine 10 is connected to the network, in the first embodiment).

Figure 16:
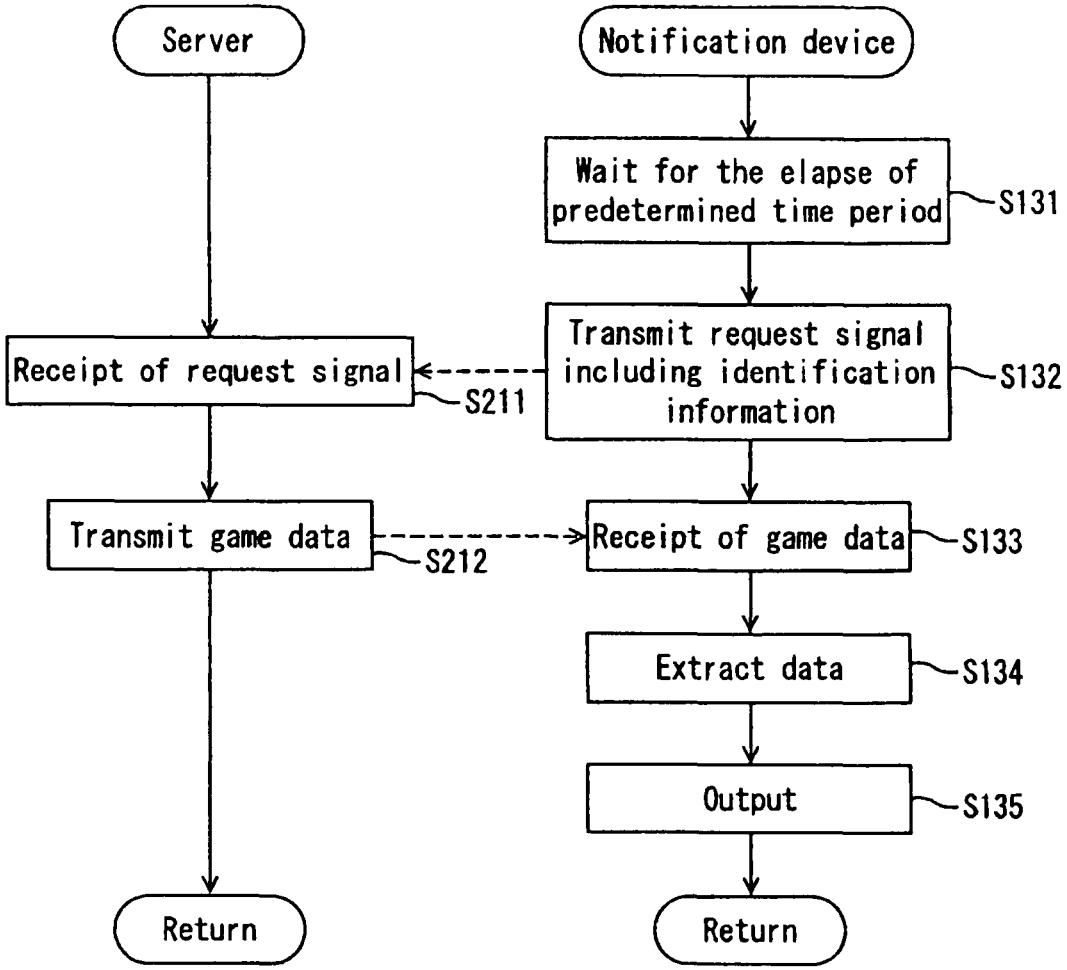
FIG. 16 is a flow chart illustrating processing in the server and in the ceiling notification device, according to the second embodiment of the present invention.

FIG. 16 is a flow chart illustrating processing in the server and in the ceiling notification device, according to the second embodiment of the present invention.

First, at step S131, the ceiling-notification-device controlling CPU 311 waits for the elapse of a predetermined time period, on the basis of time information from the timer 316. After the elapse of the predetermined time period, the ceiling-notification-device controlling CPU 311 proceeds to step S132.

At step S132, the ceiling-notification-device controlling CPU 311 transmits the aforementioned request signal (a signal indicative of a request for transmission of game data in the gaming machine 10 installed in association with the ceiling notification device 300) to the server controlling CPU 201. Unlike the request signal transmitted at step S122 in FIG. 15, the request signal transmitted at step S132 includes identification information stored in the ROM 312 (information about the gaming machine identification number provided to the gaming machine 10 installed in association with the ceiling notification device 300). The server-controlling CPU 201 receives this request signal through the transmitter 315 and the communication interface 204, at step S211.

Subsequently, at step S212, the server controlling CPU 201 transmits game data of the gaming machine 10 (data about games being played in this gaming machine 10, including information about the game histories of players) corresponding to the identification information included in the request signal received at step S211. The ceiling-notification-device controlling CPU 311 receives this game data through the communication interface 204 and the receiver 314, at step S133.

Next, at step S134, the ceiling-notification-device controlling CPU 311 extracts output data (the data to be referred to in outputting images and sounds to the image display panel 301 and the speaker 302), from the output-data storage area 312A of the ROM 312, on the basis of the game data received at step S133.

Next, at step S135, the ceiling-notification-device controlling CPU 311 causes the image display panel 301 and the speaker 302 to output images and sounds, on the basis of the output data extracted at step S134.

After conducting the processing at step S135, the ceiling-notification-device controlling CPU 311 ends the present subroutine.

Thus, the description of the second embodiment of the present invention has been completed.

Although the present invention has been described with reference to embodiments thereof, these embodiments merely illustrate concrete examples, not restrict the present invention. The concrete structures of respective means and the like can be designed and changed as required. Furthermore, there have been merely described most preferable effects of the present invention, as the effects of the present invention, in the embodiments of the present invention. The effects of the present invention are not limited to those described in the embodiments of the present invention.

Further, in the aforementioned detailed description, characteristic portions have been mainly described, for ease of understanding the present invention. The present invention is not limited to the embodiments described in the aforementioned detailed description, but can be also applied to other embodiments over a wider range of applications. Further, the terms and phrases used in the present specification have been used for clearly describing the present invention, not for limiting the interpretation of the present invention. Further, those skilled in the art will easily conceive other structures, systems, methods and the like which are included in the concept of the present invention, from the concept of the present invention described in the present specification. Accordingly, the description of the claims is intended to include equivalent structures that fall within the technical scope of the invention. Further, the abstract aims at enabling engineers and the like who belong to the present technical field but are not familiar with the patent office and public institutions, the patent, law terms and technical terms to immediately understand the technical content and the essence of the present application through brief studies. Accordingly, the abstract is not intended to restrict the scope of the invention which should be evaluated from the description of the claims. It is desirable that literatures and the like which have been already disclosed are sufficiently studied and understood, in order to sufficiently understand the objects of the present invention and the specific effects of the present invention.

In the aforementioned detailed description, there have been described processes to be executed by computers. The aforementioned description and expressions have been described for the sake of enabling those skilled in the art to understand the present invention most effectively. In the present specification, each step for deriving a single result should be understood to be self-consistent processing. Further, each step includes transmission, reception, recording and the like of electric or magnetic signals. Although, in the processing at each step, such signals have been expressed as bits, values, symbols, characters, terms, numerical characters and the like, it should be noticed that they have been merely used for convenience of description. Further, although the processing at each step was described using expressions common to human behaviors in some cases, the processes described in the present specification are to be executed by various types of devices, in principle. Further, other structures required for conducting each step will be apparent from the aforementioned description.

What is claimed as new and desired to be secured by Letters Patent of the United States is:

1. A system comprising:

a slot machine which runs a first game in a first mode, the slot machine shifting to a second mode in which a second game is run and generating a trigger signal when a predetermined condition is established in the first mode, the slot machine configured to output a first information about results of execution of the first and second games and including a first speaker, a first image display panel displaying a first image, and a second image display panel displaying a second image different from the first image; and a data output device which is externally and detachably mounted to the slot machine, is configured to output a second information about a return to be given when the predetermined condition is established in the first mode, and is not configured to run the first game and the second game, including:

an output device capable of outputting an image and a sound and including a second speaker and a third image display panel displaying a third image different from the first and second images;

a memory which stores a plurality of types of output data for the third image and the sound outputted by the output device, the output data related to the predetermined condition;

a receiver for receiving, from a slot machine, the trigger signal including specification information for specifying the output data as the slot machine runs the game; and a controller programmed to conduct the processes of:

(A) receiving the trigger signal from said slot machine through said receiver; and (B) extracting, from among the plurality of types of output data stored in said memory, an output data specified by the specification information included in said trigger signal and causing said output device to output the third image and the sound based on said extracted output data.

2. The system according to claim 1, wherein the second information comprises a third information that the second mode is being conducted and a fourth information about a condition required for reaching the predetermined condition.

3. A data output method that is performed by a controller of a data output device which is externally and detachably mounted to a slot machine and is not configured to run the first game and the second game, wherein the slot machine runs a first game in a first mode and shifts to a second mode in which a second game is run when a predetermined condition is established in the first mode, wherein the slot machine is configured to output a first information about results of execution of the first and second games and comprises a first speaker, a first image display panel displaying a first image, and a second image display panel displaying a second image which is different from the first image, and wherein the data output device is configured to output a second information about a return to be given when the predetermined condition is established in the first mode, the method comprising the steps of:

(a) receiving a trigger signal including specification information for specifying output data, the trigger signal output from the slot machine when the predetermined condition is established in the first mode and received through a receiver; and (b) extracting an output data corresponding to the specification information included in said trigger signal, from among a plurality of types of output data which is stored in a memory of the data output device and related to the predetermined condition, and causing an output device configured to output a third image different from the first and second images and a sound and including a third image display panel and a second speaker to output the third image and the sound based on the extracted output data, wherein each of said steps (a) and (b) is conducted by the controller.

4. The method according to claim 3, wherein the second information comprises a third information that the second mode is being conducted and a fourth information about a condition required for reaching the predetermined condition.

5. A system comprising:

a slot machine which runs a first game in a first mode and shifts to a second mode in which a second game is run when a predetermined condition is established in the first mode, the slot machine configured to output a first information about results of execution of the first and second games and including a first speaker, a first image display panel, and a second image display panel, and;

a server which is connected to the slot machine, receives predetermined information from the slot machine as the slot machine runs the game, and outputs a trigger signal to a data output device when the predetermined condition is established in the first mode in the slot machine; and the data output device which is configured to output a second information about a return to be given when the predetermined condition is established in the first mode, is associated with the slot machine, independent from the slot machine, connected to the server, and receives the trigger signal from the server, said data output device comprising:

an output device configured to output an image and a sound and including a second speaker and a third image display panel;

a memory which stores a plurality of types of output data for the image and the sound outputted by the output device and identification information for identifying a slot machine installed in association with said data output device, the output data related to the predetermined condition;

a receiver for receiving, from a server connected to the slot machine, the trigger signal including specification information for specifying output data and the identification information of said slot machine; and a controller programmed to conduct the processes of:

(A) receiving the trigger signal from the server through said receiver;

(B) determining whether or not the identification information included in said trigger signal matches the identification information stored in said memory; and (C) extracting, from among the plurality of types of output data stored in said memory, an output data specified by the specification information included in said trigger signal and causing said output device to output the image and the sound based on said extracted output data, upon determining through said process (B) that the identification information included in said trigger signal matches the identification information stored in said memory, wherein the data output device is not configured to run the first game and the second game.

6. The system according to claim 5, wherein the second information comprises a third information that the second mode is being conducted and a fourth information about a condition required for reaching the predetermined condition.

7. A data output method that is performed by a data output device which is associated with a slot machine, independent from the slot machine, wherein the slot machine runs a first game in a first mode and shifts to a second mode in which a second game is run when a predetermined condition is established in the first mode, wherein the slot machine is configured to output a first information about results of execution of the first and second games, and wherein the slot machine comprises a first speaker, a first image display panel, and a second image display panel, and the data output device configured to output a second information about a return to be given when the predetermined condition is established in the first mode, connected to a server which is connected to the slot machine, receiving predetermined information from the slot machine as the slot machine runs the game, and outputting a trigger signal to a data output device when the predetermined condition is established in the first mode in the slot machine, the method comprising the steps of:

(a) receiving a trigger signal including specification information for specifying output data related to the predetermined condition and identification information for identifying a slot machine, the trigger signal received through a receiver which receives the trigger signal from a server connected to the slot machine;

(b) determining whether or not the identification information included in said trigger signal matches identification information of the slot machine, the identification information of the slot machine being pre stored in a memory of the data output device, the slot machine being installed in association with a controller; and (c) extracting an output data corresponding to the specification information included in said trigger signal out of a plurality of types of output data for outputting an image and a sound, the plurality of types of output data being pre stored in said memory, and causing an output device configured to output the image and the sound and including a third image display panel and a second speaker to output the image and the sound based on said extracted output data, upon determining through said step (b) that the identification information included in said trigger signal matches the identification information of the slot machine, wherein each of said steps (a) to (c) is conducted by said controller, and wherein the data output device is not configured to run the first game and the second game.

8. The method according to claim 7, wherein the second information comprises a third information that the second mode is being conducted and a fourth information about a condition required for reaching the predetermined condition.

9. A system comprising:

a slot machine which runs a first game in a first mode and shifts to a second mode in which a second game is run when a predetermined condition is established in the first mode, the slot machine configured to output a first information about results of execution of the first and second games and including a first speaker, a first image display panel, and a second image display panel: and a data output device which is configured to output a second information about a return to be given when the predetermined condition is established in the first mode, is associated with the slot machine, independent from the slot machine, and connected to the slot machine and/or a server that is connected to the slot machine, said data output device comprising:

a transmitter for transmitting a request signal for making a request for transmission of game data including information regarding history of the first game to the slot machine or the server;

a receiver for receiving the game data transmitted from said slot machine or said server which received said request signal;

an output device configured to output an image and a sound and including a second speaker and a third image display panel;

a memory which stores a plurality of types of output data for the image and the sound outputted by the output device; and a controller, wherein said controller is programmed to conduct the processes of:

(A) transmitting said request signal to said slot machine or said server through said transmitter;

(B) receiving said game data requested by the request signal from said slot machine or said server having received the request signal through said receiver; and (C) extracting, from among the plurality of types of output data stored in said memory, an output data for outputting information indicating a condition to establish the predetermined condition based on said received game data and causing said output device to output the image and the sound based on said extracted output data, and wherein the data output device is not configured to run the first game and the second game.

10. A data output method that is performed by a controller of a data output device which is associated with a slot machine, wherein the slot machine runs a first game in a first mode and shifts to a second mode in which a second game is run when a predetermined condition is established in the first mode, wherein the slot machine is configured to output a first information about results of execution of the first and second games, and wherein the slot machine comprises a first speaker, a first image display panel, and a second image display panel, the data output device configured to output a second information about a return to be given when the predetermined condition is established in the first mode, independent from the slot machine, and connected to a server that is connected to the slot machine, the method comprising the steps of:

(a) transmitting a request signal for making a request for transmission of game data, said request signal transmitted to a slot machine or a server through a transmitter;

(b) receiving the game data requested by the request signal, from the slot machine or the server having received the request signal through a receiver; and (c) extracting an output data for outputting information indicating a condition to establish the predetermined condition based on said received game data, from a plurality of types of output data which is stored in a memory of the data output device for outputting an image and a sound, and causing an output device configured to output the image and the sound and including a third image display panel and a second speaker to output the image and the sound based on said extracted output data, each of said steps (a) to (c) conducted by a controller, wherein the data output device is not configured to run the first game and the second game.

11. A system comprising:

a slot machine which runs a first game in a first mode and shifts to a second mode in which a second game is run with one of a plurality of types of contents when a predetermined condition is established in the first mode, the slot machine configured to output a first information about results of execution of the first and second games and including a first speaker, a first image display panel displaying a first image, and a second image display panel displaying a second image different from the first image; and a data output device which is externally and detachably mounted to the slot machine, is configured to output a second information about a return to be given when the predetermined condition is established in the first mode, and is not configured to run the first game and the second game, including:

an output device capable of outputting an image and a sound and including a second speaker and a third image display panel displaying a third image different from the first and second images;

a memory which stores a plurality of types of output data for the third image and the sound outputted by the output device;

a receiver for receiving, from the slot machine, a trigger signal including specification information for specifying the output data; and a controller, said controller programmed to conduct the processes of:

(A) receiving the trigger signal from said slot machine through said receiver, when said slot machine shifts from the first mode to the second mode; and (B) extracting, from among the plurality of types of output data stored in said memory, an output data specified by the specification information included in said trigger signal and causing said output device to output the third image and/or the sound indicating with which one of the plurality of types of contents the second game is run, based on said extracted output data.

12. The system according to claim 11, wherein the predetermined condition is constituted by plural conditions and each of the conditions is associated with one of the plurality of types of contents, when one of the plural conditions is established, the slot machine runs the second game with one of the plurality of types of contents associated with said one of the plural conditions, and the data output device extracts, in the process (B), the output data specified by the specification information indicating said one of the conditions, and outputs the sound and the image indicating the said one of the conditions, based on the output data.

13. The system according to claim 11, wherein the second games in the second mode are free games, the predetermined condition is that a number of the first games run by the slot machine reaches a set of predetermined values, and a number of the second games run in the second mode varies depending on the predetermined values.

14. A data output method that is performed by a controller of a data output device which is externally and detachably mounted to a slot machine and is not configured to run the first game and the second game, wherein the slot machine runs a first game in a first mode and shifts to a second mode in which a second game is run with one of a plurality of types of contents when a predetermined condition is established in the first mode, wherein the slot machine is configured to output a first information about results of execution of the first and second games and comprises a first speaker, a first image display panel displaying a first image, and a second image display panel displaying a second image different from the first image, and wherein the data output device is configured to output a second information about a return to be given when the predetermined condition is established in the first mode, the method comprising the steps of:

(a) receiving a trigger signal including specification information for specifying output data, the trigger signal output from a slot machine and received through a receiver, when said slot machine shifts from the first mode to the second mode; and (b) extracting an output data corresponding to the specification information included in said trigger signal, from among a plurality of types of output data which is stored in a memory of the data output device, and causing an output device configured to output a third image different from the first and second images and a sound and including a third image display panel and a second speaker to output the third image and the sound indicating with which one of the plurality of types of contents the second game is run, based on the extracted output data, wherein each of said steps (a) and (b) is conducted by the controller.

15. The data output method according to claim 14, wherein the predetermined condition is constituted by plural conditions and each of the conditions is associated with one of the plurality of types of contents, when one of the plural conditions is established, the slot machine runs the second game with one of the plurality of types of contents associated with said one of the plural conditions, and the data output device extracts, in the step (b), the output data specified by the specification information indicating said one of the conditions, and outputs the sound and the image indicating the said one of the conditions, based on the output data.

16. A system comprising:

a slot machine which runs a first game in a first mode and shifts to a second mode in which a second game is run with one of a plurality of types of contents when a predetermined condition is established in the first mode, the slot machine configured to output a first information about results of execution of the first and second games and including a first speaker, a first image display panel, and a second image display panel;

a server which is connected to the slot machine, receives predetermined information from the slot machine as the slot machine runs the first game, determines whether the predetermined condition is established based on the predetermined information, and outputs a trigger signal to a data output device if it is determined that the predetermined condition is established; and the data output device which is configured to output a second information about a return to be given when the predetermined condition is established in the first mode, is associated with the slot machine, independent from the slot machine, connected to the server, and receives the trigger signal from the server, said data output device comprising:

an output device configured to output an image and a sound and including a second speaker and a third image display panel;

a memory which stores a plurality of types of output data for the image and the sound outputted by the output device and identification information for identifying a slot machine installed in association with said data output device;

a receiver for receiving, from a server connected to the slot machine, the trigger signal including specification information for specifying output data and the identification information of said slot machine; and a controller, wherein said controller is programmed to conduct the processes of:

(A) receiving the trigger signal from the server through said receiver;

(B) determining whether or not the identification information included in said trigger signal matches the identification information stored in said memory; and (C) extracting, from among the plurality of types of output data stored in said memory, an output data specified by the specification information included in said trigger signal and causing said output device to output the image and the sound indicating with which one of the plurality of types of contents the second game is run, based on said extracted output data, and wherein the data output device is not configured to run the first game and the second game.

17. The system according to claim 16, wherein the predetermined condition is constituted by plural conditions and each of the conditions is associated with one of the plurality of types of contents, when one of the plural conditions is established, the slot machine runs the second game with one of the plurality of types of contents associated with said one of the plural conditions, and the data output device extracts, in the process (B), the output data specified by the specification information indicating said one of the conditions, and outputs the sound and the image indicating the said one of the conditions, based on the output data.

18. A data output method that is performed by a data output device which is associated with a slot machine, independent from the slot machine, wherein the slot machine runs a first game in a first mode and shifts to a second mode in which a second game is run with one of a plurality of types of contents when a predetermined condition is established in the first mode, wherein the slot machine is configured to output a first information about results of execution of the first and second games, and wherein the slot machine comprises a first speaker, a first image display panel, and a second image display panel, the data output device configured to output a second information about a return to be given when the predetermined condition is established in the first mode, connected to a server which is connected to the slot machine, receiving predetermined information from the slot machine as the slot machine runs the first game, determining whether the predetermined condition is established based on the predetermined information, and outputting a trigger signal to a data output device if it is determined that the predetermined condition is established, the method comprising the steps of:

(a) receiving a trigger signal including specification information for specifying output data and identification information for identifying a slot machine, the trigger signal received through a receiver which receives the trigger signal from a server connected to the slot machine;

(b) determining whether or not the identification information included in said trigger signal matches identification information of the slot machine, the identification information of the slot machine being pre stored in a memory of the data output device, the slot machine being installed in association with a controller; and (c) extracting an output data corresponding to the specification information included in said trigger signal out of a plurality of types of output data for outputting an image and a sound, the plurality of types of output data being pre stored in said memory, and causing an output device configured to output the image and the sound and including a third image display panel and a second speaker to output the image and the sound indicating with which one of the plurality of types of contents the second game is run, based on said extracted output data, upon determining through said step (b) that the identification information included in said trigger signal matches the identification information of the slot machine, wherein each of said steps (a) to (c) is conducted by said controller, and wherein the data output device is not configured to run the first game and the second game.

19. The data output method according to claim 18, wherein the predetermined condition is constituted by plural conditions and each of the conditions is associated with one of the plurality of types of contents, when one of the plural conditions is established, the slot machine runs the second game with one of the plurality of types of contents associated with said one of the plural conditions, and the data output device extracts, in the step (b), the output data specified by the specification information indicating said one of the conditions, and outputs the sound and the image indicating the said one of the conditions, based on the output data.

* * * * *